US006209779B1

(12) United States Patent
Fabel

(10) Patent No.: US 6,209,779 B1
(45) Date of Patent: Apr. 3, 2001

(54) LAMINATED MAILER BLANK WITH TRANSPARENT WINDOW

(75) Inventor: Warren M. Fabel, Delray Beach, FL (US)

(73) Assignee: Laser Substrates, Inc., Boca Raton, FL (US)

( * ) Notice: Subject to any disclaimer, the term of this patent is extended or adjusted under 35 U.S.C. 154(b) by 0 days.

(21) Appl. No.: 09/449,440

(22) Filed: Nov. 24, 1999

Related U.S. Application Data

(63) Continuation-in-part of application No. 09/132,036, filed on Aug. 11, 1998, which is a continuation-in-part of application No. 08/434,416, filed on May 3, 1995, now Pat. No. 5,791,553, which is a continuation-in-part of application No. 08/240,869, filed on May 10, 1994, now abandoned.

(51) Int. Cl.[7] ..... B65D 27/00
(52) U.S. Cl. ..... 229/92.3; 229/92.8; 229/301
(58) Field of Search ..... 229/92.8, 92.1, 229/92.3, 301

(56) References Cited

U.S. PATENT DOCUMENTS 5,752,647 * 5/1998 Schubert et al. ..... 229/92.1
5,836,622 * 11/1998 Fabel ..... 229/92.8 X
5,950,910 * 9/1999 Petkovsek ..... 229/92.8
6,019,280 * 2/2000 Peterson ..... 229/305

* cited by examiner

*Primary Examiner*—Jes F. Pascua
(74) *Attorney, Agent, or Firm*—Ted W. Whotlock

(57) ABSTRACT

A mailer blank having a return receipt post card which can be printed on both faces thereof by a single pass through a non-impact, simplex printer is described. The return receipt post card is configured to present all areas to be printed with variable information on a single face of the postcard, thereby allowing printing of all variable information in a single pass through the printer. The post card is provided with fold lines such that a unique folding pattern results in formation of a post card of standard size and uniform thickness, and having the variable printed information ultimately positioned at desired locations on both sides (faces) of the post card.

12 Claims, 13 Drawing Sheets

LAMINATED MAILER BLANK WITH TRANSPARENT WINDOW

RELATION TO OTHER PATENT APPLICATIONS

This is a continuation-in-part of U.S. patent application Ser. No. 09/132,036, filed Aug. 11, 1998, which is a continuation-in-part of U.S. patent application No. 08/434,416 filed May 3, 1995, now U.S. Pat. No. 5,791,553, which is a continuation-in-part of U.S. patent application Ser. No. 08/240,869, filed May 10, 1994, now abandoned.

BACKGROUND OF THE INVENTION

1. Field of the Invention

This invention relates to a flat, laminated sheet for being folded into a mailer with a transparent window, and more particularly to providing such a sheet in a form which can be fed reliably through printing and folding devices. The subject invention further relates to such mailers having a detachable return receipt post card integral therewith.

2. Description of the Prior Art

A number of different types of mailer blanks are used to provide mailers after suitable printing and folding operations. A typical mailer, after the printing operations are completed, includes at least some variable information, such as the address of the individual to whom the mailer will be sent. The mailer may also have fixed information, which is applied in an identical manner to a large number of mailers.

It is often particularly desirable to print the address to which the mailer is being sent, along with other variable information as needed, on a part of the mailer blank which becomes the inside of an envelope structure after the folding processes are completed. Often, a transparent window is provided on a part of the mailer blank through which a portion of the printed information can be viewed after the printing and folding processes are completed. Such a window is conventionally formed by adhesively attaching a transparent sheet of plastic or cellulose material to extend across an aperture which has been die cut in the sheet of paper forming the mailer blank. By properly aligning the printing, the address information can be read through the transparent window positioned opposite to the address information after folding. In this way, it becomes unnecessary to print variable information on both sides of the mailer blank; rather, all such information is printed on the surface which becomes the inside of the envelope structure, thereby saving a printing step.

For example, when a mailer of the type just described is used to distribute checks, the name and address of the recipient may be visible both as the location to which the mailer is addressed and as the payee of the check. Upon receipt, the envelope is opened and the check portion is separated from the remaining portion of the mailer by tearing along a perforated line. Other variable information, such as the amount of the check and account numbers is printed on the same side of the mailer blank as the check, but is concealed when mailer is folded for mailing.

U.S. Pat. No. 4,951,864 to Dicker describes apparatus a typical prior art mailer blank and the folding and sealing thereof. Dicker's mailer blank includes remoistenable glue strips on the longitudinal sides and one traverse side of the blank, which strips are moistened prior to folding into a mailer envelope. A window aperture shown within the mailer is formed by adhesively attaching a transparent sheet to extend across a rectangular opening in the paper of the mailer. However, the transparent sheet overlaps the opening, being adhesively attached to the paper around the opening, causing the localized increase in thickness.

A particular problem with a conventional mailer blank of the type described above arises as a result of the additional thickness of the transparent sheet used to form the window. A typical mailer blank is made from 0.004 inches thick paper stock and 0.001 inch thick transparent sheet attached by an adhesive around an aperture in the paper stock. Thus, around the edges of the aperture, where the paper stock and the transparent sheet overlap, the thickness of the mailer blank is increased by 0.001 inch, or 25 percent of the paper thickness. Because of this difference in thickness, the mailer blanks do not lie flat when they are stacked for feeding into the, apparatus used for the printing and folding apparatus. They further do not lie flat when stored as inventory or shipped from the point of manufacture to the end user's facilities. Even if shims are used in packing, the mailer blanks generally have a permanent curl when they are removed from the cartons in which they are shipped and stored.

More recently, it has become common practice for a company such as an insurance company or other organization, to provide an identification card (ID card) to an individual wherein the ID card bears a particular identification number, e.g., a membership or account number, that can be used in storing or retrieving a computerized record relating to that individual. These ID cards are typically manufactured in bulk, preprinted, and inserted into a mailing envelope.

Moreover, this previous method of providing an ID card increases the number of steps involved in producing individualized mailers. Specifically, the address or other information provided on the mailer must be printed separately from the ID card. The ID card must then be inserted into the mailer, which involves yet another step. This can also result in mismatches between the mailer confirmation and the ID card information that may cause loss of further time and effort in correcting the error.

Mailers for high volume applications are preferably printed and subsequently folded in high speed devices having an input capacity of, for example, 2000 sheets. However, due to the difference in thickness abound the window aperture, a stack of 2000 sheets of mailer blanks manufactured as described above is typically about twelve inches thick around the aperture and about eight inches thick at locations remote from the aperture, such as the edge of the form being fed into the printing and folding devices. Furthermore, these sheets cannot lie flat an any bin holding them in quantities of about 2000 for feeding into a printing or folding device.

The various mechanisms used to feed sheets one at a time through printing and folding devices are very intolerant of curled sheets, particularly if the curl results in the corners of an individual sheet being raised or lowered with respect to the central part of the sheet. Specifically, the curl prevents individual sheets from being properly separated in the mechanisms designed to separate the sheets so that they can be fed one at a time for printing or folding. In addition, the curl causes the corners of the sheets to be caught on various obstructions along the paper feeding path of the printing and folding devices. In this way, failures to feed sheets and various types of paper jams are caused as the equipment is operated.

A further problem is realized by use of separately printed and inserted ID cards. Specifically, a high speed printer/ folder device cannot be utilized efficiently with these cards because they will either jam a form feeder or will need to be adhered prior to the mailer being automatically folded.

These problems have become more serious with an increased use of non-impact printers, such as laser printers, to print the variable information on mailers, since such printers require the rapid and reliable feeding of individual sheets of paper into the printing process.

Attempts have been made to eliminate the need for a second transparent sheet by treating a section of the paper form so that the paper becomes transparent in a particular window area. For example, the See Thru Paper ™Window, Form #9644, manufactured by Standard Register, is described in U.S. Pat. No. 5,418,205. However, the transparency of the window area is actually only "translucent", which can pose problems for automated mail reading devices.

Yet another problem in the mailing form industry is to provide a form having a return receipt post card of uniform thickness which can be conveniently printed by a single pass through a simplex, non-impact printer. Previously, confirmation of receipt of a mailed document required filling out a separate return receipt post card for a particular addressee. Typical return receipt post cards have address information or other identifying information printed on both sides of the card. Thus, not only do conventional return receipt post cards require filling out a separate form, but can also be disadvantageous because they cannot ordinarily be printed on a simplex, non-impact printer by a single pass through the printer.

What is needed is a mailer blank having an aperture with an open or transparent window, without the increased local thickness resulting in paper curl when significant numbers of the blanks forms are stacked.

What is also needed is a mailer blank which does not require separate printing and adherence of an identification card so that printing and folding can be efficiently carried out on an automated device.

It is also desirable to provide such a form with a return receipt post card integral therewith, wherein the return receipt post card is of uniform thickness and can have information printed on both faces of the card in a single pass through a non-impact, simplex printer.

SUMMARY OF THE INVENTION

In accordance with one aspect of the invention, there is provided a mailer blank having an aperture to form a window allowing printed information to be viewed or read through this formed window. This formed window can have a transparent layer of material covering the aperture.

Certain features of this invention are described in the patents or applications from which this invention claims priority, namely, U.S. patent application Ser. No. 09/102,852, U.S. patent application Ser. No. 09,097,246, filed Jun. 12, 1998, U.S. Pat. No. 5,836,622, U.S. patent application Ser. No. 09/132,036, U.S. Pat. No. 5,791,553, U.S. patent application Ser. No. 09/361,660, U.S. Pat. No. 5,954,431, U.S. patent application Ser. No. 09/293,633, and U.S. Pat. No. 5,899,504. Each of these patents and applications is hereby incorporated by reference.

In one embodiment, the mailer blank can have a transparent layer and an opaque layer on one side of said transparent layer. The opaque layer includes an aperture covered by said transparent layer to form a window. Further, the opaque layer and transparent layer are co-extensive outward from the aperture to lateral and transverse edges of the mailer.

In another embodiment of the subject invention, the mailer blank comprises a die cut area forming identification card (ID card) blanks which can be efficiently printed and folded in an automated printer/folder or folder/sealer device. Advantageously, the ID cards are preferably formed contiguously in an inner layer of the form and can be easily removed therefrom by separating them from the die cut.

In yet another embodiment of the subject invention, the mailer blank comprises a return receipt post card which can be printed on both faces thereof by a single pass through a non-impact, simplex printer. The return receipt post card in this embodiment is configured to present all areas to be printed with variable information on a single face of the postcard, thereby allowing printing of all variable information in a single pass through the printer. The post card is provided with fold lines such that a unique folding pattern results in formation of a post card of standard size and uniform thickness, and having the variable printed information ultimately positioned at desired locations on both sides (faces) of the post card.

This embodiment has several additional advantages. For example, the form has the capability of being folded and duplexed to form a post card of uniform thickness meeting the requirements of the United States Postal Service (USPS). The generation of variable printed information on a single surface of the form by a single pass through a simplex, non-impact printer also guarantees that a mismatching of the variable printed information will not occur.

This embodiment can also be provided in several different variations. One variation provides windows having a backing or panel of transparent material which can serve as protection of the envelope contents. Preferably, the transparent panel is laminated to the inner face of the printed sheet so that any risk of jamming of the printer or the folder/sealer device is substantially reduced. An alternative variation of this embodiment of the subject invention comprises apertures or windows as cutout areas.

Yet another variation of this embodiment has the letter portion of the form selectively adhered, e.g., glued, around the perimeter edge only, such that the inner faces of the plies can be preprinted, thereby providing up to three printable faces of a letter in the form. Thus, the form can provide more space for text than a conventional folded form having only one face available for printing. Perforated strips formed around the perimeter, when removed by the addressee, can defeat the adherence around the perimeter edge and allow up to three page faces of the plies to be viewed with text printed thereon.

Each of these variations of this embodiment of the subject invention provides an advantageous mailing form on which finishing operations can be performed on a high speed folder/sealer device commonly used in the industry. For large volume mailing, this application can be especially advantageous in that no manual processing is required. Therefore, the forms can be printed on a high-speed non-impact printer, usually in excess of 100 PPM) and then finished and ready for mailing at up to about 40,000 documents per hour.

BRIEF DESCRIPTION OF THE DRAWINGS

Preferred embodiments of the subject invention are hereafter described with specific reference being made to the following Figures, in which.

DETAILED DESCRIPTION

Figure 1:
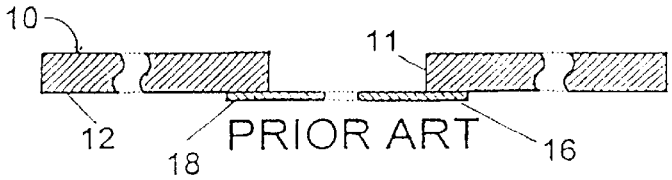
FIG. 1 is a fragmentary, transverse elevational view of a prior art mailer blank formed in accordance with a conventional method, taken through a transparent window provided therein.
Figure 2:
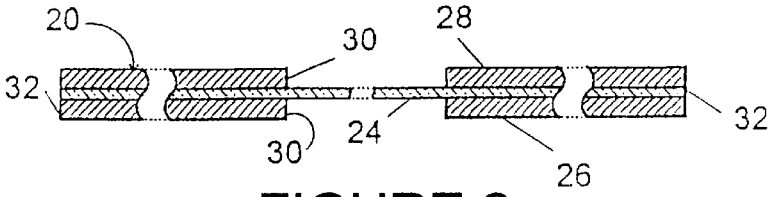
FIG. 2 is a fragmentary, transverse elevational view of a mailer blank formed in accordance with a first version of the present invention, taken through a transparent window provided therein.
Figure 3:
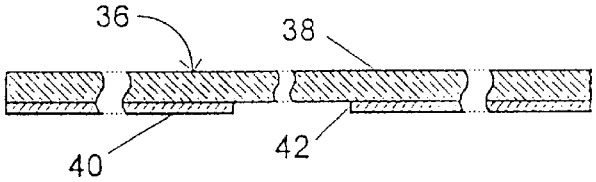
FIG. 3 is a fragmentary, transverse elevational view of a mailer blank formed in accordance with a second version of the present invention, taken through a transparent window provided therein.

Basic differences between a mailer blank constructed according to the prior art and a mailer blank constructed according to the present invention will first be discussed, with references to FIGS. 1–3, each of which is a partial transverse cross-sectional elevation view of a respective mailer blank taken through the window aperture therein. In particular, FIG. 1 illustrates the prior art mailer blank; FIG. 2 illustrates a first embodiment of the present invention; and FIG. 3 illustrates a second embodiment of the present invention.

Referring first to FIG. 1, a typical prior art mailer blank 10 having an aperture window 11 conventionally placed in a sheet 12 of standard paper stock, approximately 0.004 inches in thickness. Aperture 11 is typically formed by die cutting during the manufacture of mailer blank 10. A transparent sheet 16, approximately 0.001 inches in thickness, is attached to cover aperture 11, overlapping in overlap regions 18 extending along each edge of aperture 11. The attachment of transparent sheet 16 is accomplished in overlap regions 18, for example, through the use of an adhesive. Because the thickness of mailer blank 10 in overlap regions 18 includes both the paper thickness, the thickness of the transparent sheet, and the thickness of the adhesive, the total thickness of a stack of 2000 mailers 10 is increased from approximately eight inches to approximately twelve inches between the edges thereof and region 18.

Referring to FIG. 2, a mailer blank 20 fabricated in accordance with a first embodiment of the present invention includes a transparent layer 24, such as a transparent plastic film, laminated between an inner layer 26 of paper stock and an outer layer 28 of paper stock. The designations of "outer" and "inner" are included at this point to indicate the paper layer which will form the outer surface of an envelope, when mailer blank 20 is subsequently folded, from the paper layer which will form the inner surface of the envelope. Each paper layer 26 and 28 includes an aperture 30, which may be formed using conventional die cutting techniques during the manufacture of mailer blank 20. The two apertures 30 are aligned so that, when mailer blank 20 is folded into a predefined shape for mailing, visible information can be viewed through apertures 30 and transparent layer 24.

Since transparent layer 24 extends to the edges 32 of mailer blank 20, the thickness of mailer blank 20 is uniform across its entire surface. The uniform thickness is also achieved even if transparent layer 24 slightly overextends or under-extends paper stock layers 26 and 28. It should be noted that the reduction in thickness caused by the elimination of the paper within apertures 30 does not effect the ability of a stack of mailer 20 to be stacked evenly and fed through printing and folding equipment. The thicknesses of both transparent layer 24 and paper layers 26 and 28 are determined to provide suitable stiffness to allow reliable processing through printing and folding operations, as well as to be within the regulations of the U.S. Postal Service for automatic handling of envelopes. Preferably, each of paper layers 26 and 28 has a thickness of about 0.0025 inches, while transparent layer 24 has a thickness of about 0.001 inches.

Alternatively, one of paper layer 26 or 28 may be eliminated in FIG. 2, in which case the, thickness of the remaining paper layer should be 0.004 inches.

Referring now to FIG. 3, a mailer blank 36, fabricated in as a second embodiment of the present invention, is formed using a transparent layer 38 having a side on which an opaque layer 40 is coated. Opaque layer 40 preferably is a ultraviolet rotary screen ink material having a white or pastel color appearance, and having appropriate chemical and physical properties allowing the application thereto of inks and toners by conventional printing, processes. It should be noted that opaque layer 40 may be coated on both sides of transparent layer 38 so that mailer 20 resembles the appearance of conventional paper.

An aperture 42 is formed by leaving an open area in opaque layer 40. Again, the increased thickness caused by the overlap condition of the prior art mailer blank 10 (shown in FIG. 1) does not occur, so large numbers of mailer blanks 36 may be stacked for shipping, storage, and, in hoppers for being fed individually into printing and folding devices. To provide suitable stiffness for use as a mailer, the thickness of transparent layer 38 is preferably increased into the range of 0.003 to 0.005 inches.

Alternately, a mailer blank of the type described with respect to FIGS. 2 or 3 may be made using a paper layer 26 laminated to a one side of transparent layer 24 or 38, with the opposite side of transparent 24 or-38 being coated with opaque layer 40. In this case, the thickness of transparent layer 24 or 38 would be 0.001 inches.

Referring to FIGS. 2 and 3, transparent layers 24 and 38 are preferably composed of materials capable of passing through the thermal fusing station of a typical laser printer with minimal dimensional changes and curling. A suitable mate rial for these applications is polyethylene terephthalate film. The application of opaque coating 40 is facilitated by applying an antistatic or priming layer to the transparent film layers 24 or 38. A suitable process for applying an antistatic layer is described in U.S. Pat. No. 4,371,489 to McGrail. Depending on the adhesive process used to form the laminations of FIG. 2, this type of coating may also be used to prepare transparent layer 24 for lamination. It should further be noted that the thickness of transparent layer 24 may vary between 0.0005 and 0.00125 inches, with 0.001 inches being a preferred thickness for the first embodiment, as described above with respect to FIG. 2; a preferred thickness being between about 0.003–0.005 inches for transparent layer 38 for the second embodiment, as described above with respect to FIG. 3.

One preferred type of material that may be used for transparent layers 24 and 38 is Melinex 1311, one distributor of which is Plastic Suppliers, 1174 Hayes Industrial Drive, Marrietta, Ga. 35062. Melinex 1311 is a clear film with anti-static properties on both surfaces of its web. Its surface resistivity, independent of gauge, is $2\times10^{10}$ ohms/square, which overcomes the static electricity and laser corona based problems which generally prevent stacks of plastic films from being used with laser printers. Moreover, Melinex 1311 film does not suffer from unacceptable shrinkage, when passed through the high heat of the fusing stage of a laser printer. Melinex 1311 polyester film is described in more detail in U.S. Pat. No. 4,371,489 in the name of Patrick T. McGrail and entitled "Production of Antistatic Thermoplastic Films". Additional problems encouraging the use of Melinex 1311 film are discussed in my co-pending patent application, Ser. No. 08/394,062, filed Dec. 1, 1994 and entitled "Transparent Security Pocket Compatible With Non-impact Printers". Melinex 1311, or its equivalent without the antistatic coating, may be used as the transparent layer where paper covers substantially both sides of the transparent plastic film, such as shown in FIG. 2.

Figure 4:
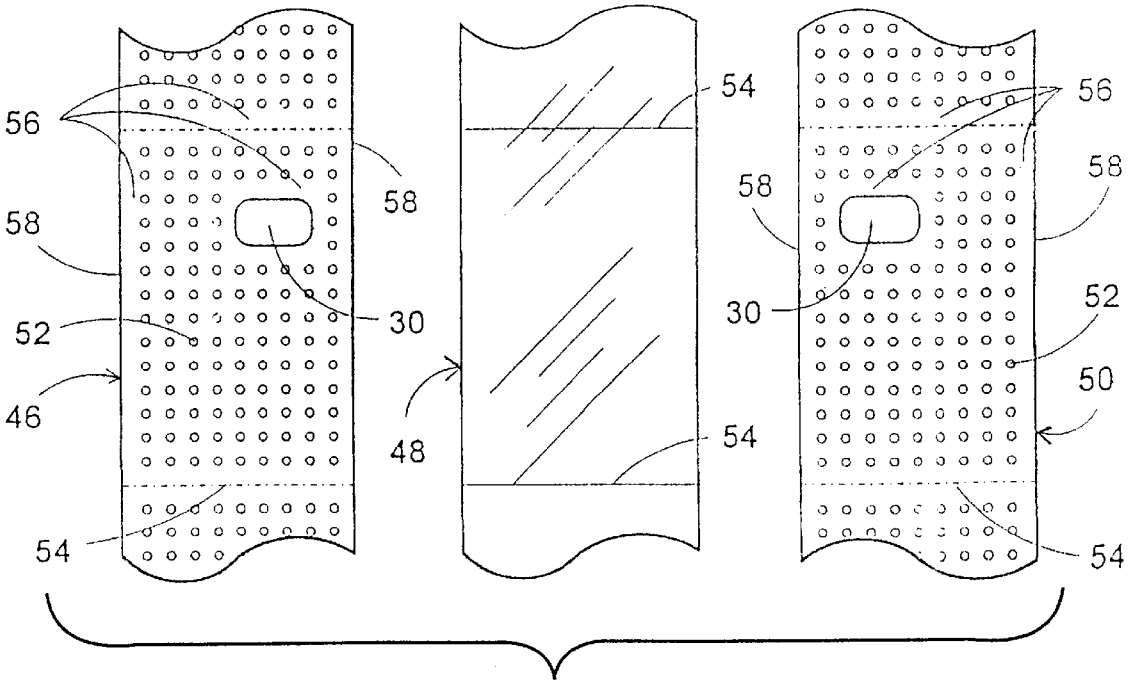
FIG. 4 is a fragmentary plan view of two paper webs and of a transparent web which are laminated together and cut to length to form the mailer blank of FIG. 2.

Referring now to FIG. 4, a plan view is shown of two paper webs 46 and 50 and one transparent web 48. These three webs 46, 48 and 50 are laminated together and cut to length to form mailer blank 20 shown in FIG. 2. More specifically, inner paper web 46 forms inner paper layer 26, transparent web 48 forms transparent layer 24, and an outer paper web 50 forms outer paper layer 28. Preferably, each paper web 46 and 50 is imprinted with a fine array of adhesive dots 52 on surface 54 to be applied against transparent web 48. In order to avoid cluttering, a relatively course array of dots 52 is shown for illustrative purposes in FIG. 4. Dots 52, for example, are formed of a pressure sensitive adhesive applied using either a screen printing process or a flexographic printing process. Applying adhesive dots 52 in this manner minimizes the bulk of the adhesive, while providing a desirable type of flexibility in mailer blank 20 at a cost effective price.

In FIG. 4, paper layers 46 and 50 are oriented to show adhesive dots 52, that is, both paper layers 46 and 50 are transversely displaced from transparent web 48, and inner paper web 46 is shown as being inverted from the orientation it has when laminated to transparent web 48. In the lamination process, outer layer 50 is applied, with pressure exerted between nip rollers (not shown), to a first side of, transparent web 48, and inner layer 46 is applied, also with pressure exerted between nip rollers (not shown) to the side of transparent web 48 opposite the first side. Each paper web 46 and 50 includes a number of apertures 30, which are arranged so that apertures 30 of outer web 46 individually align with the apertures 30 of inner web 50 following the lamination process.

Continuing to refer to FIGS. 2 and 4, the laminated web formed by laminating paper webs 46 and 50 to transparent web 48 is subsequently cut into suitable lengths, each such length to be used as a mailer blank 20. In FIG. 4, the location of the cuts between adjacent mailer blanks is indicated by lines 54. Conventional electronic registration or a pattern preprinted on the non-adhesive coated surface of one of the paper webs 46 or 50 may be used for determining the location of each of the apertures 30 and cuts 54. Various perforations and/or cuts through one or both paper layers may also be made on the laminated web at appropriate locations prior to making each cut 54 to separate the web into mailer blanks 20. As described hereafter, these additional perforations and cuts facilitate the subsequent folding and/or use of each mailer blank 20 into an envelope configuration.

Adhesive dots 52 are preferably arranged in a pattern which provides gaps 56, in which adhesive dots 52 are not applied to paper webs 46 and 50. Gaps 56, for example, are placed along the outer edges 58 of the webs, around apertures 30, and along the locations, indicated by lines 54, where the web will be cut into suitable lengths. Gaps 56 prevent the outward flow of adhesive during the subsequent movement of mailer blank 20 through the heat and pressure fusing station of a laser printer which may subsequently be used to print information on mailer blank 20. A gap width from an adjacent edge of 0.020 to 0.125 inches is preferably used for this purpose, depending on the type and quantity of adhesive used in the lamination process. Without gaps 56, adhesive material could be squeezed out of mailer blanks 20 and accumulate in the fusing station of the printer, resulting in the contamination of the printer. A similar gap for the adhesive dots 52 may also be placed around apertures 30.

Figure 5:
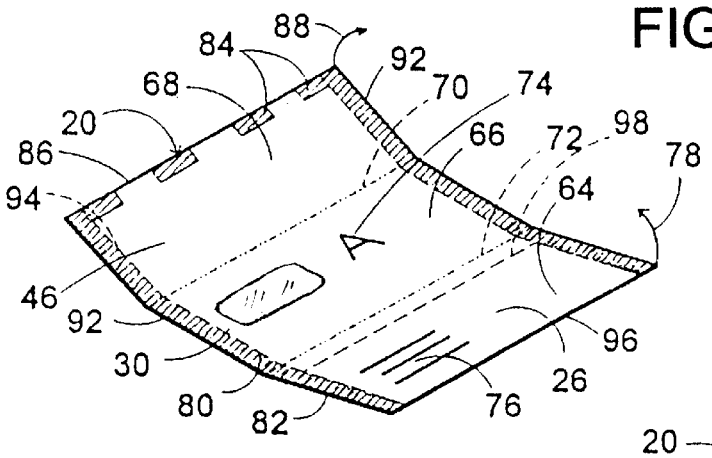
FIG. 5 is an isometric view of a mailer formed from the mailer blank of FIG. 2, shown after-printing.

Referring now to FIG. 5, an isometric view of a mailer formed from mailer blank 20 is shown in a state following the printing and lamination. The reference numerals used in FIGS. 2 and 4 are also used to indicate like features in FIG. 5. In FIG. 5, mailer 20 includes a lower portion 64, a central portion 66, and an upper portion 68. Central portion 66 may be separated from upper portion 68 by an upper fold line 70, and from lower portion 64 by a lower fold line 72. Fold lines 70 and 72 may be perforated or compressed lines formed during the manufacture of mailer blank 20 after the lamination, as shown and described with respect to FIG. 4, or they may merely be the fold lines resulting from the operation of folding devices into which mailer blank 20 is to be subsequently fed.

Both fixed information, which does not vary from one mailer 20 to another during the preparation of a batch of mailers 20, and variable information, which does vary from one mailer 20 to another, are printed on inner paper layer 26 formed as a part of web 46. The variable information includes at least a name and address, which is to be printed-in area 76 and oriented to be visible through aperture 30 when mailer 20 is folded along lower fold line 72 in the direction indicated by arrow 78. Thus, the printed information should be oriented as indicated by the orientation of the letter "A" 74 in FIG. 5. Variable information is expected to be printed using a simplex non-impact printer, such as a laser printer or an ink jet printer, whereas fixed information can be printed using the same non-impact printer or it may be preprinted during or after the manufacture of mailer 20 by normal commercial printing processes. Where the fixed and variable information are printed together, they may be printed during a single pass through the non-impact printer, as all necessary information need only be printed on inner paper layer 26.

Where fixed information is preprinted, colors and patterns not readily available using a non-color, non-impact printer may be included on form 20 and printing can occur on both inner layer 26 and outer layer 28. For example, the preprinting may even occur on one or both of paper webs 46 and 50 (on the side opposite to the side on which adhesive dots 52 are placed) prior to applying adhesive dots 52 and laminating webs 46 and 50 to transparent web 48, as seen in FIG. 4.

Mailer 20 also includes an adhesive strip 80 extending adjacent to each lateral edge 82 and a segmented adhesive strip 84 extending adjacent an upper transverse edge 86. In FIG. 5, adhesive strips 80 and 84 are indicated by cross-hatching. While strip 80 is shown as continuous, it is understood that it also can be broken into noncontinuous segments or otherwise patterned to control the amount of adhesive applied. Adhesive strips 80 and 84 are preferably composed of a material which can pass through the various processing stations of a non-impact printer, including the fusing station, without adverse effects. For example, the material forming adhesive strips 80 and 84 may be a microencapsulated adhesive or a remoistenable adhesive. In addition, during the manufacture of mailer 20, suitable longitudinal perforated lines 94 may be formed along the inner boundary of adhesive strip 80, in order to permit mailer 20 to be opened by the recipient.

Figure 6:
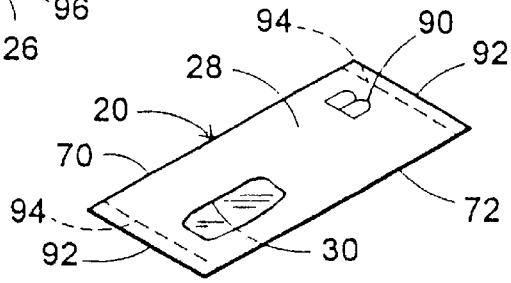
FIG. 6 is an isometric view of the mailer of FIG. 5, shown after folding and adhesive sealing.

Mailer 20 is prepared for mailing by folding first along lower fold line 72, in the direction of arrow 78, and then along upper fold line 70, in the direction of arrow 88. Pressure, or a combination of pressure and moisture, is applied to the adhesive strips 80 and 84 to seal mailer 20 in its folded condition, as seen in FIG. 6. A number of commercially available devices, well known in the art of producing mailers for distribution, may be used to facilitate both the folding operation and the activation of adhesive strips 80 and 84 through pressure or through a combination of moisture and pressure. U.S. Pat. No. 4,951,864 to Dicker describes both an adhesive system and a folding and sealing device which can be used for this purpose.

Referring now additionally to FIG. 6, there is shown an isometric view of mailer blank 20 after the folding and adhesive sealing thereof. Fixed information is imprinted on outer paper layer 28, oriented as indicated by the letter "B" 90, to provide, for example, a return address, bulk mail permit information, and opening information. Alternatively, a second window may be included in mailer blank 20 for showing a return address printed on inner paper layer 26.

When mailer 20 is received, it is opened by tearing away ends 92, which have been affixed together through the use of longitudinally extending adhesive strips 80. Separable perforated lines 94 provided during the manufacture of mailer blank 20 facilitate opening. Next, the transversely extending adhesive strip 84 is pulled away from the portion of outer paper layer 28 to which it is attached. Mailer 20 is then opened by unfolding outward along upper fold line 70, in the direction opposite to arrow 88, and by folding outward along lower fold line 72, in the direction opposite to arrow 78.

Mailer 20 may include a portion 96 which is separable from the remainder of mailer 20 along a perforated tear line 98, which also is formed during the manufacture of mailer blank 20. For example, this separable portion 96 may be a check having the name and address of the payee printed in address field 76.

Figure 7:
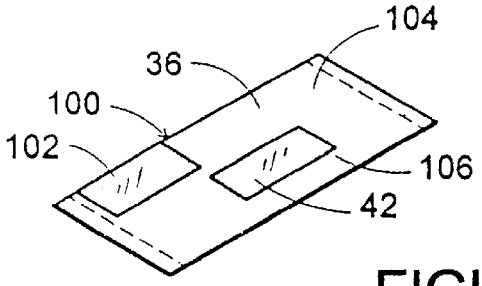
FIG. 7 is an isometric view of a mailer formed from the mailer blank of FIG. 3, shown folding and adhesive sealing.

Referring again to FIG. 3, a mailer blank 36, composed of a thicker transparent plastic film layer 38 having an opaque coating 40, may be perforated and folded as described with respect to FIGS. 5 and 6, resulting in a finished appearance as shown in FIG. 7. A number of printing processes, including the electro-photographic processes of laser printers, may be used to apply printed images to transparent plastic surfaces. Primer coats of various types, or the antistatic coating process described in U.S. Pat. No. 4,371,489 may be used to improve various aspects of this printing process. Alternately, opaque coating 40 may be applied to both sides of transparent layer 38, with apertures aligned in each of the opaque coatings 40, generally as shown in FIG. 2.

Referring now to FIG. 7, there is shown a perspective view of a mailer 100 formed from mailer blank 36 (as shown in FIG. 3), having opaque coating 40 on the inner surface of the envelope and a pair of windows 42 and 102. Specifically, window 102 is provided to facilitate printing the return address on the inner side of mailer 100 together with the addressee's address, which is seen through window 42, as previously explained. Where the transparent plastic film is a transparent polyester film, such as Melinex 1311, fixed information, such as bulk permit information, can be preprinted on the outer surface 28 thereof.

Figure 8:
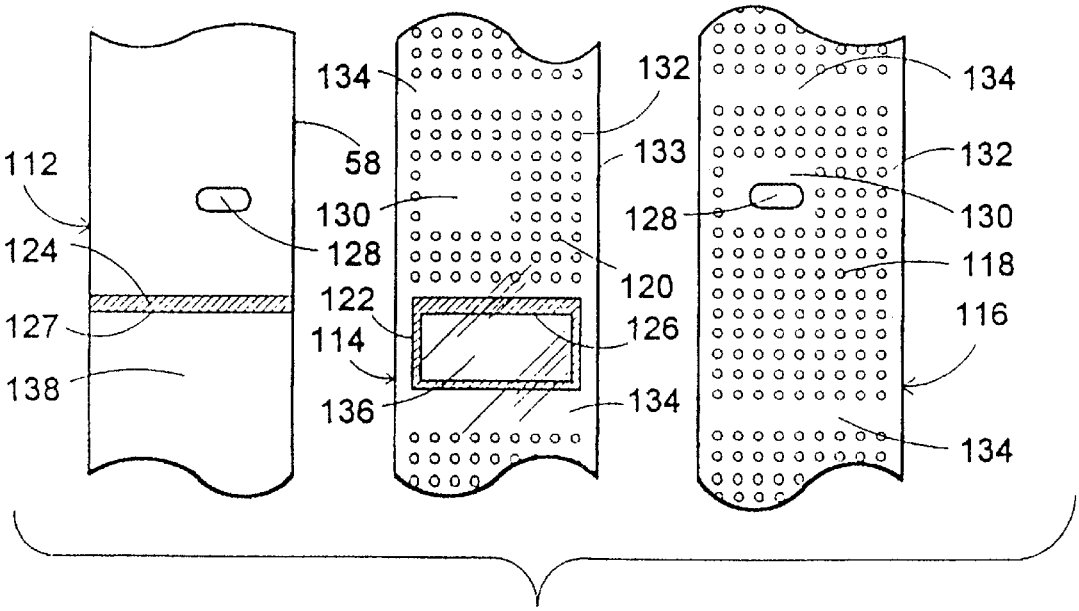
FIG. 8 is a fragmentary plan view of two paper webs, and of a transparent web, which are laminated together and cut to length to form a mailer blank in accordance with a third version of the present invention.
Figure 9:
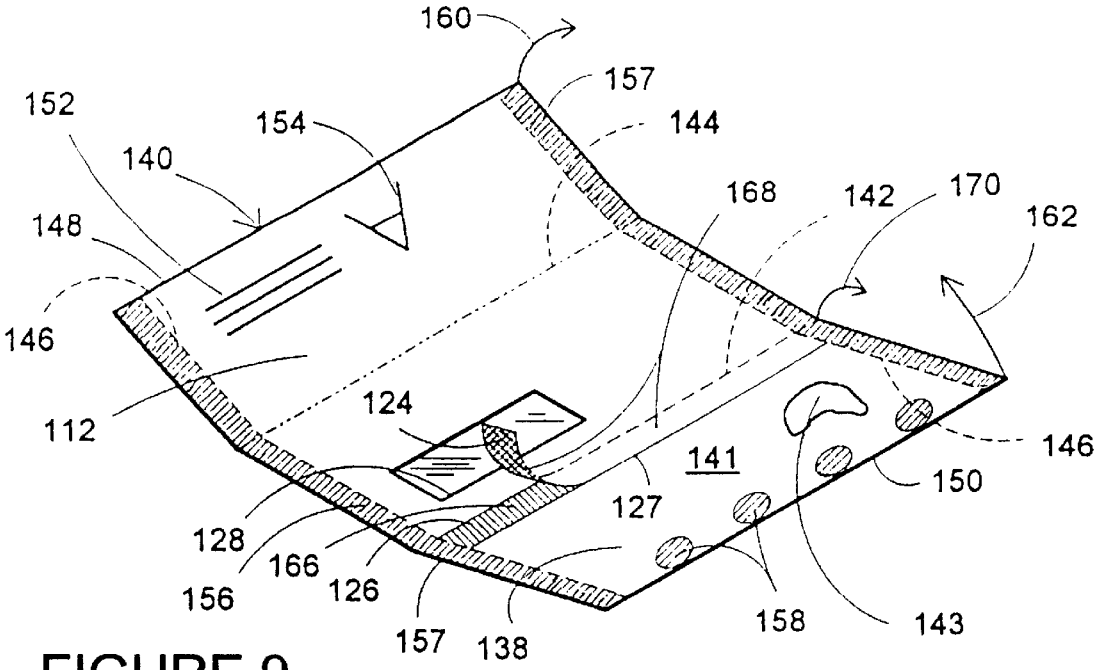
FIG. 9 is an isometric view of a mailer formed from the webs of FIG. 8, shown after printing.

Referring now to FIGS. 8 and 9, there is shown a third embodiment of the present invention, in which an integral envelope 141 is included with a mailer blank 140. Mailer blank 140 provides integral second envelope 141, which can be used by the recipient of mailer 140 to return a document to the original sender of mailer 140. A typical application for mailer 140 is to send a statement in the expectation that a check will be returned in integral second envelope 141. Generally, FIG. 8 shows a fragmentary plan view of two paper webs 112 and 116 and a transparent web 114, which are laminated together and cut to length to form mailer blank 140; and FIG. 9 shows an isometric view of mailer blank 140, formed from webs 112, 114 and 116, in a condition after manufacture and printing and before folding and adhesive fastening.

Referring specifically to FIG. 8, inner paper web 112 is laminated to an upper surface of transparent web 114, and outer paper web 116 is laminated to a lower surface of transparent web 114. Inner paper web 112 subsequently forms an inner surface of mailer blank 140, while outer paper web 116 subsequently forms an outer surface of mailer blank 140. On the surface of outer paper web 116, adjacent to transparent web 114, is a repeating array pattern of adhesive dots 118. As in FIG. 4, a relatively course array is shown for illustrative purposes. Transparent web 114 similarly has a repeating array pattern of adhesive dots 120, together with a hollow rectangular pattern 122, around which adhesive 126 has been applied in a continuous or more dense manner. Inner paper web 112 has a strip of release agent 124 coated thereon in a position to prevent its permanent adhesion to transverse adhesive strip 126. Adjacent to one edge of release agent 124 on inner paper web 112 is a slit tear line 127, which is formed after the lamination of webs 112, 114 and 116. To show the pattern of a release agent 124 in FIG. 8, inner paper web 112 is inverted from the orientation it must assume when it is laminated to transparent web 114.

In addition, apertures 128 are cut in each of paper webs 112 and 116 similar to apertures 30 in FIG. 4. Further, various clear areas 130, 132, 134, Where no adhesive dots 120 are present are placed on webs 114 and 116. More specifically, clear area 130 is placed to be in alignment with apertures 128, clear area 132 is placed along the longitudinal edges 133 of webs 114 and 116, clear area 134 is placed where transverse cuts will subsequently be placed to separate individual forms to be made from laminated webs 112, 114 and 116.

In the process of laminating webs 112, 114, and 116, apertures 128 in paper webs 112 and 116 are aligned with one another and with clear area 130 in transparent web 114. At the same time, release agent 124 is aligned with transverse adhesive strip 126. Paper web 112 is generally attached to transparent web 114, through the array of adhesive dots 120, except in clear areas 130, 132 and 134 and in rectangular area 136 surrounded by hollow rectangular adhesive pattern 122. Paper web 116 is generally attached to transparent, web 114, except for similarly clear areas 130, 132, and 134. As previously described with to FIG. 4, keeping adhesive dots 120 away from edges 133 of mailer blank 140 prevents the contamination which could otherwise result from the outward squeezing of adhesive 120 as mailer blank 140 passes through the fusing station of a laser printer.

A portion 138 of inner paper web 112 is not laminated directly to transparent web 114 in the area adjacent to clear area 136 and is subsequently used in the formation of integral second envelope 141. Because portion 138 is thus not supported by direct lamination to transparent web 114, the overall thickness of inner paper web 112 is about 0.003 to 0.004 inches, while the thickness of outer paper web 118 is preferably held at about 0.0025 inches.

Referring to FIGS. 8 and 9, after the lamination process, a number of perforations are cut to extend through all three layers 112, 114 and 116. More specifically, a transverse perforated tear line 142, and two longitudinal perforated tear lines 146 are placed on mailer blank 140. In addition, transverse slit tear line 127 is cut through layer 112 only. Optionally, a perforated transverse fold line 144 may be cut, particularly if it is desired that the recipient be able to remove a portion of mailer 140 and return it in envelope 141. The laminated weld is then cut to length, forming an upper transverse edge 148 and a lower transverse edge 150. Variable data is printed in an address field 152, being oriented as indicated by the letter "A" 154. Fixed data, and additional variable data, is printed in other areas as desired. As previously described with respect to FIG. 5, an adhesive layer 156 is coated along each longitudinal edge 157, and a series of adhesive dots 158 is placed along lower transverse edge 150.

The process of using mailer 140 begins with folding mailer 140 along fold line 144 in the direction of arrow 160, so that address field 152 becomes visible through aperture 128. Next, mailer 140 is folded along perforated line 142, in the direction of arrow 162. Adhesive coatings 156 and 158 hold mailer 140 in its folded shape. As previously described with respect to FIG. 5, a number of well known, commercially available document folding devices can be used to assist in the folding and gluing of mailer 140.

After receipt, the recipient opens mailer 140 by separating it along longitudinal tear lines 146 and by prying transverse adhesive dots 158 away from their attachment to outer layer 116 near fold line 144. At this point, mailer 140 appears as seen in FIG. 9, but without the side strips below adhesive layer 156 and further without adhesive dots 158. Next, mailer 140 is separated along tear line 127, thereby exposing the interior pocket 143 of envelope 141 formed between inner paper layer 112 and transparent layer 114. In FIG. 9, inner paper layer 112 is shown as partly cut away to show the interior pocket 143. The limits of pocket 143 are defined by adhesive pattern 126, as inner paper layer 112 in lower portion 138 is not directly attached to the adjacent clear portion 136 of transparent layer 114. Envelope 141 may be used to return an item, such as a check and/or the portion of mailer 140 between perforated line 144 and edge 148, to the organization originally sending mailer 140. After envelope 141 is removed from the remainder of mailer 140 along perforated tear line 142, a closure flap 166, having a tear strip 168 thereon, extends between transverse tear lines 142 and 127 and separates pocket 143 from the edge of envelope 141. At this point, the check, or other item to be returned to the sender of mailer 140, is inserted into pocket 143 and tear strip 168 is removed, exposing adhesive 126, as seen in FIG. 9. On the bottom of tear strip 168, release material 124 is also removed, as it is in a weak contact with adhesive 126. Finally, flap 166 is folded over in the direction of arrow 170 and seals envelope 141 for mailing.

Figure 10:
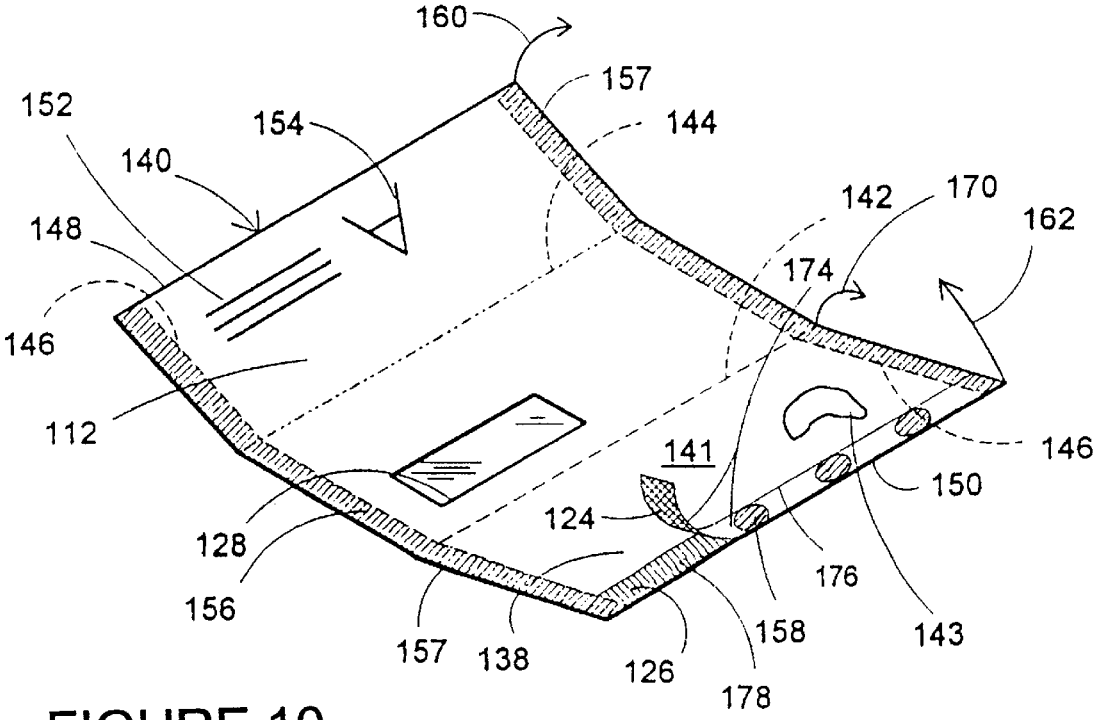
FIG. 10 is an isometric view of an alternate version of the mailer shown in FIG. 9.

Referring now to FIG. 10, an alternate version 172 of mailer blank 140 is shown in which the tear strip 174 and closure flap 178 are placed along the edge 150 instead of along perforated fold line 142. In FIG. 10, like numerical designations are used for similar components shown in FIG. 9. The changes between mailer 140 and mailer 172 are that slit tear line 127 is replaced by slit tear line 176 defining closure flap 178 as being between line 178 and edge 150. Adhesive dots 158 are then placed over tear strip 174 and are removed when tear strip 174 is peeled away. With this change, the adhesive dots 158 do not remain on the return envelope 141 after it is sealed. Further, adhesive 126 in FIG. 8 needs to be rotated 180 degrees and release layer 124 in FIG. 8 needs to be moved downward from the positions shown.

Yet another embodiment of the subject invention includes a laminated form blank for generating identification cards (ID cards) at high speeds on a laser printer in a machine foldable mailer format. These ID cards are issued to individuals by companies, e.g., health or auto insurance companies, or other organizations such as trade organizations, to provide a wallet-sized card bearing information about the individual, including, for example, an identification number.

Figure 11:
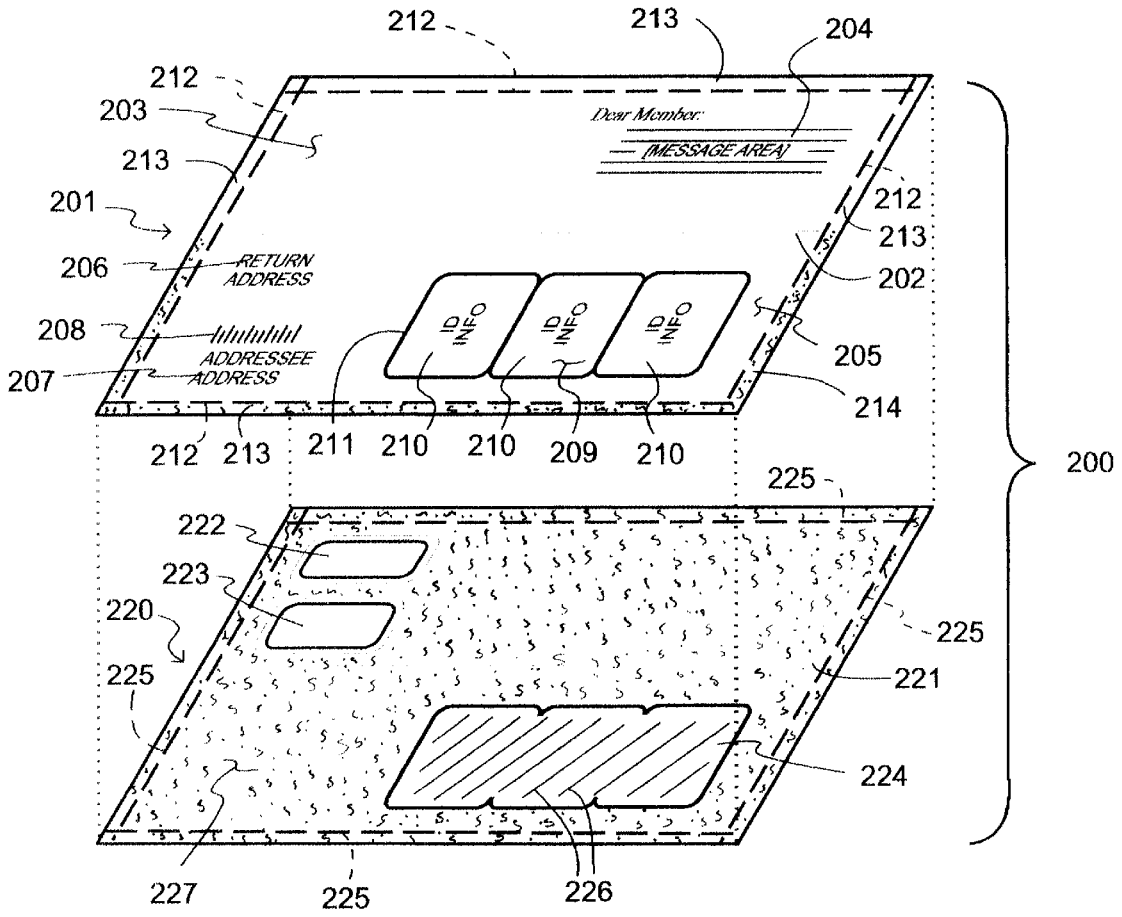
FIG. 11 is an exploded, perspective view of an embodiment for providing an identification card in the folding mailer form according to the subject invention.

One preferred embodiment is illustrated in FIGS. 11–15. Referring to FIG. 11, the subject form 200 is shown in exploded perspective view to illustrate a front or top, substantially transparent sheet 201, and a back or bottom, substantially opaque sheet 220 which are superimposably adjoined to form the two-ply laminated mailing form.

The front sheet 201, as described, is a sheet preferably rectangular and more preferably of standard paper size, provides areas for printing variable information by a non-impact printer. The front sheet is typically divided into two approximately equal halves by a fold line 202 which traverses a central longitudinal axis. The fold line can be formed by a printed line or other indicator, can be a die-cut or score line formed in the front sheet, or can be an imaginary line which is subsequently folded on an automated folding device.

The top half 203 of the front sheet 201 provides a message area 204 for printing information or use or interest to the addressee. The message area 204 is preferably provided toward the top right side of front sheet 201 to allow for proper positioning of other information on the left side of the bottom half 205 of front sheet 201.

On the bottom half 205 of front sheet 201 is provided address areas 206 and 207. Address area 206 is provided for printing a return address of the sender of the mailing form. Address area 207 is provided for printing address information for the addressee. This addressee information can include a bar code 208 useful for automated mail readers used by the United States Postal Service.

On the right side of the bottom half 205 of front sheet 201 is provided an area for printing identification card information. This identification card information area 209 can be printed so that information (shown as "ID INFO" in FIG. 11), e.g., name, date of birth, address, identification number, or the like, can be provided on at least one removable identification card (ID card) 210 to be retained by the addressee. The ID card 210 can be formed by making a die cut or perforation 211 around the entire ID card information area such that an ID card containing the identification information is separable from the rest of the front sheet 201.

A variation of this embodiment shown in FIG. 11 illustrates formation of three ID cards 210 on a single sheet. Die-cut line 211 is made around the perimeter of each individual ID card. For efficiency, die cut line 211 is coextensive for adjacent ID cards.

A perforation 212 can also be provided along each perimeter edge of front sheet 210 to provide a removable strip 213 when opening the folded mailing form.

An adhesive 214 can be disposed on at least a portion of removable strip 213 such that the top and bottom halves of front sheet 210 are adhered together along its perimeter edge when folded at fold line 202. Preferably, adhesive 214 is disposed along the bottom and two side edges, substantially covering the outer face of corresponding removable strips 213, of either the top half or bottom half of front sheet 201. In this way, the adhesive 214 matches to the corresponding outer edges of the opposing half of front sheet 201 and, along with a folded edge of the form which is created when the form is folded, provides a completely enclosed form whereas the front sheet 201 forms the inner portion of a mailer according to the subject invention.

The adhesive 214 used on the front face of the removable strips of front sheet 201 can be microencapsulated adhesive or remoistenable adhesive, depending on the folder/sealer device used for finishing. Microencapsulated adhesive must be of sufficient size to provide adequate wetting of the sealing edge, and must have sufficient coating so that the microencapsulates are not damaged when processed through a printer feeder. The coating must also be capable of withstanding heat of a laser printer so that premature adherence does not occur prior to folding and sealing of the mailer.

Figure 11A:
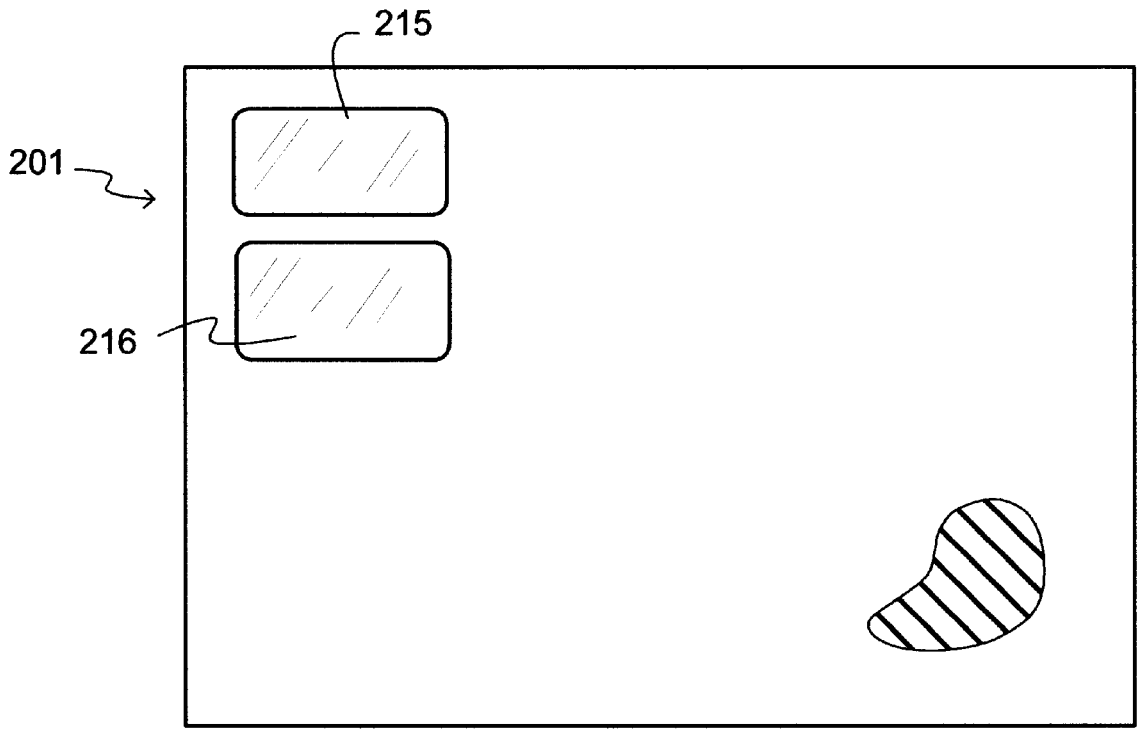
FIG. 11A shows a front or inner face of a front sheet for the embodiment of FIG. 11, having a substantially opaque coating patternly disposed thereon, illustrating a transparent window area.

The front sheet 201 can comprise a plastic or polymeric material, e.g., Melinex 311 which is commercially available. Typically, the front sheet has a thickness of between about 0.003 and 0.005 inches. The front sheet can be transparent or can be printed on one face with an opaque or contrasting color for enhancing legibility of certain variable information printed thereon. However, at least one area on the front sheet is not printed with an opaque or contrasting color so that it remains transparent to provide a window for viewing address information when the form is in its folded configuration. A preferred embodiment is shown in FIG. 11A wherein front sheet 201 (shown prior to the formation of die-cuts, perforations, or printing) is provided with two transparent areas 215 and 216 for viewing address information therethrough. Most preferably, transparent window area 215 permits viewing of the return address information, and transparent window area 216 permits viewing of the addressee information, printed on the bottom left half of the front sheet.

In one alternative variation of this embodiment, the inner face of top sheet 201 is provided with a magnetic identification strip positioned on the back of the card area to provide a conventional credit card identifier useful in accessing an automatic teller machine (ATM) or other device capable of reading such magnetic strips. Further, the inner face of ID card area 210 can be provided with an adhesive release material, as is known in the art, to facilitate removal of an ID card from its backing sheet without any residue adhesive on the card.

The back, or bottom, sheet 220 is configured to substantially conform to the areas or sections provided on the front sheet. Specifically, the back sheet 220 typically comprises a standard, e.g., 8½×11 inches, size sheet of approximately equal dimension to the front sheet. One example of this embodiment is shown in FIG. 11, wherein the back sheet is divided along its central, longitudinal axis to provide a fold line 221, conforming to the position of fold line 202 provided in front sheet 201 when the sheets are superimposed.

The back sheet 220 can be noncontiguous, having at least one cutout area provided therein to form a window so that address information can be seen therethrough when the form is in a folded configuration. FIG. 11 illustrates one embodiment showing two cutout areas 222 and 223 corresponding in position to the transparent window areas 215 and 216 in FIG. 11A. Other variations of positioning and numbers of cutout areas would be readily understood according to need and in light of the description provided herein. Typically, however, this cut-out area is provided in the left side of the upper half of the back sheet for forming a conventionally positioned envelope when folded.

On the lower half of back sheet 220 an ID card backing area 224 is formed to provide a support web or backing sheet for the ID card or cards formed by die-cuts 211 in front sheet 201.

A perforation 225 can be formed around each perimeter edge of the back sheet, substantially conforming to the superimposed position of each perforation 212 formed around the perimeter of front sheet 201. Each perforation 225 forms a removable strip 226 which can be removed upon receipt of the mailer for opening the envelope.

Adhesive 227 can be coated or otherwise disposed on the inner face of back sheet 220 so that the inner face of back sheet 220 is substantially covered with said adhesive except for window areas 222 and 223, and ID card backing area 224. In addition, an adhesive-free area, typically about 1/16inches wide, can be provided along the perimeter edge of the back sheet 220, as well as a perimeter edge of window areas 222 and 223 and ID card backing area 224 to prevent oozing of adhesive from the edges of form 200, into window areas 222 and 223, or onto ID card backing area 224 when the form is subjected to heat while being printed on a laser printer.

In the ID card backing area 224, adhesive 226 can be provided in a striated pattern so that the ID card can be easily removed therefrom. As described, an adhesive release material can also be disposed between the ID card and ID card backing to further facilitate release of the card from the backing.

The back sheet 220 is formed from standard paper stock and is preferably between about 0.001 and about 0.0025 inches thick. What is important is that the total thickness of both the front and back sheet does not exceed that which will efficiently and easily feed through a typical non-impact printer feeder for high speed and high volume printing, or does not exceed U.S. Postal Service requirements when folded.

Figure 12:
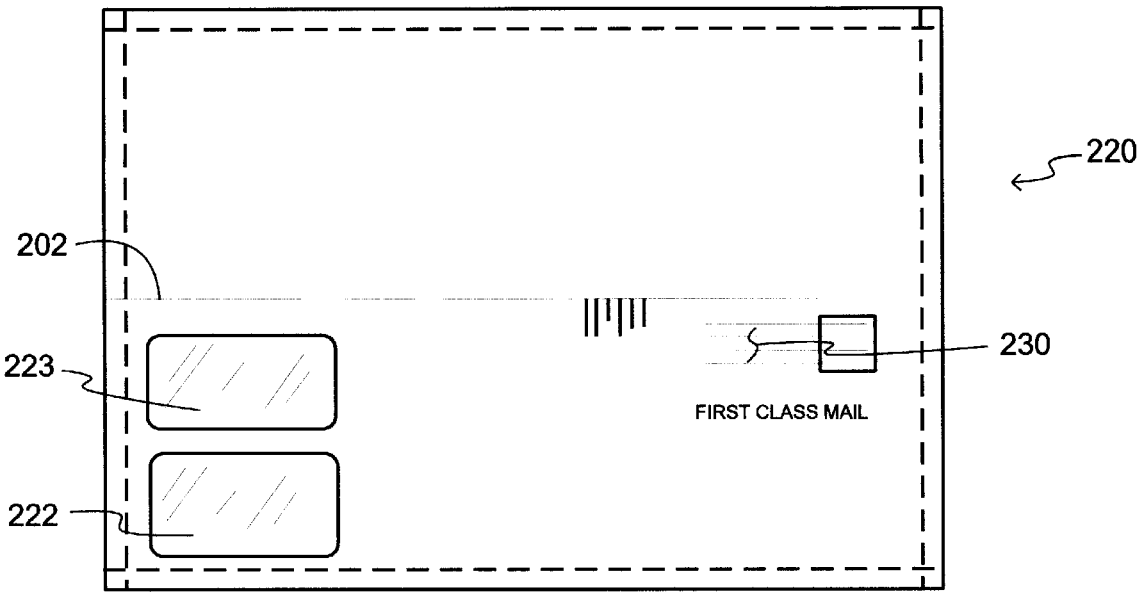
FIG. 12 shows a back face of the back sheet of the embodiment shown in FIG. 11, illustrating placement of window area cutouts and positioning of printed mailing indicia.
Figure 13:
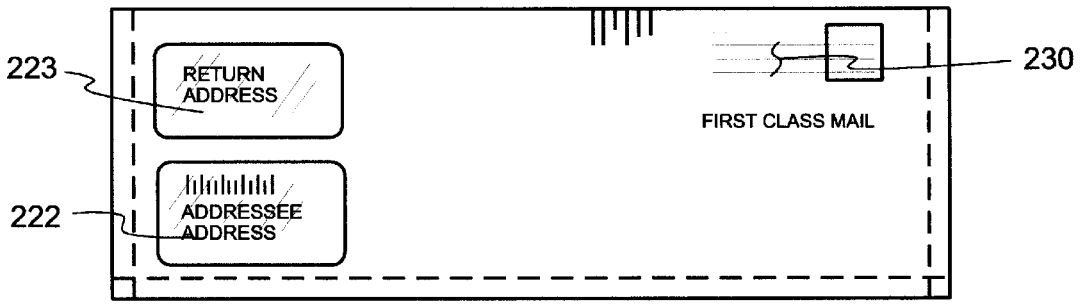
FIG. 13 illustrates the embodiment of FIGS. 11 and 12 in folded configuration.

The back face of back sheet 220 can be preprinted with mailing indicia 230 in a position to provide standard envelope positioning of the indicia. Typically, as shown in FIG. 12, mailing indicia is printed on the same section half of the back sheet, i.e., in relation to fold line 202, as the cutout areas 222 and 223. This advantageously provides for forming, in a single folding step, an envelope having address information which is visible through transparent windows 222 or 223, and mailing indicia in proper position in accordance with United States Postal Service standards. See FIG. 13. Instructions for use can also be provided on the back face of back sheet 220. For example, instructions for tearing off the removable strips can be provided for opening the sealed envelope.

In the manufacture of this embodiment of the subject invention, front sheet 201 and back sheet 220 can be preprinted with any information which is not variable or which is not necessary to be printed by a non-impact printer. For example, instructions for use, mailing indicia, certain invariable message information, or the like can be preprinted. Cut out areas in back sheet 220 can also be made. Adhesive is thus patternly disposed on the inner face of back sheet 220. The adhesive can be coated in certain areas and striated in certain other areas, for example, in the ID card backing area.

Adhesive can also be patternly disposed on the outer face (which becomes the inner portion of the form in folded configuration) of front sheet 201, particularly along removable strips 213 for sealing the envelope.

Front sheet 201 and back sheet 220 arc then superimposably adhered together to form a two-ply mailing form blank. The two-ply mailing form blank 200 can then be printed with variable information, e.g., addressee information, certain message information, or the like, by a non-impact printer, preferably a laser printer.

The printed two-ply mailing form can then be processed through an automated folder/sealer to fold the two-ply form at a predetermined fold line, e.g., fold line 202, and sealed by activating adhesive disposed on the front face of the removable strip.

Figure 14:
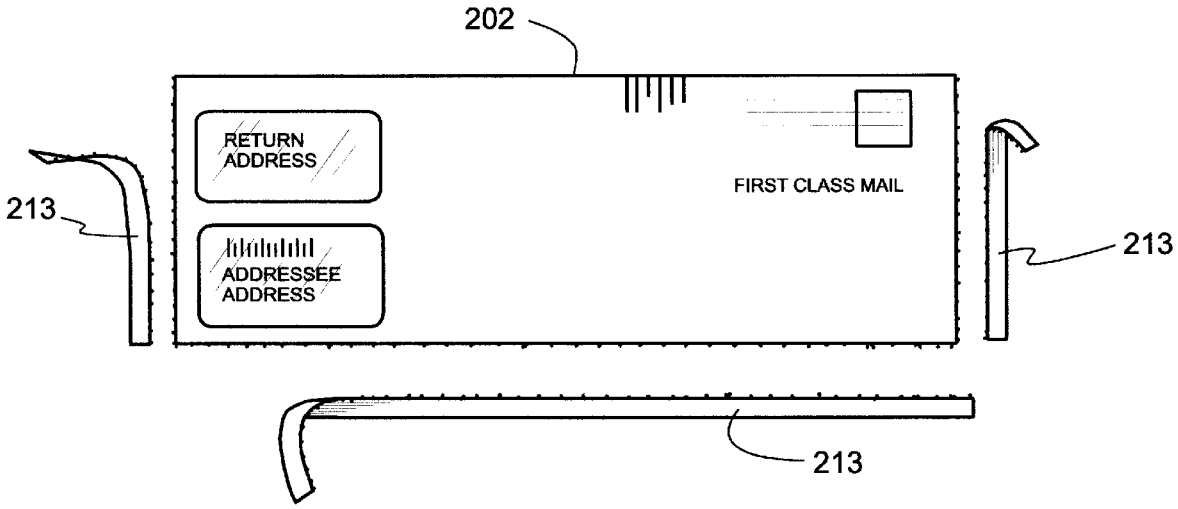
FIG. 14 shows separation of removable strips from the remainder of the ID card mailing form for opening the folding mailer document according to the subject invention.
Figure 15:
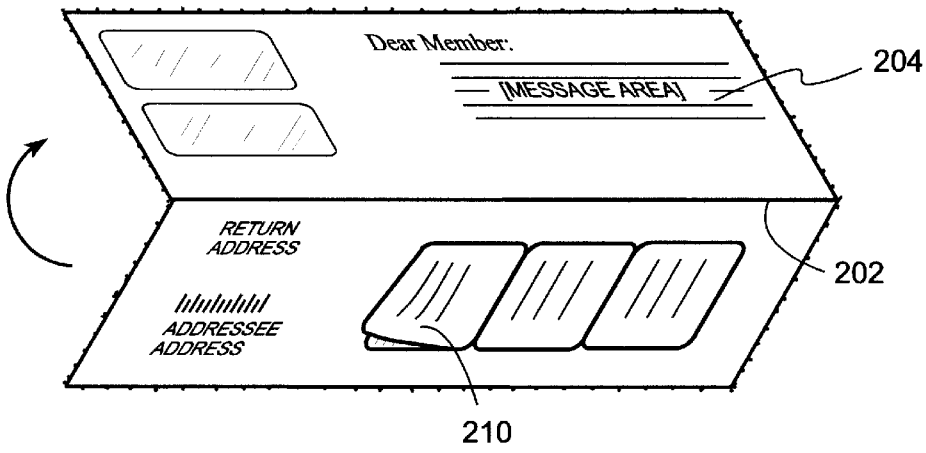
FIG. 15 shows unfolding of the mailer form according to the subject invention for reading a message and removing an identification card formed in the inner sheet of the mailer form.

FIG. 14 illustrates the procedure whereby the mailer of the subject invention can be opened upon its receipt by the addressee. Specifically removable strips 213 are separated from the folded, sealed envelope or mailer, allowing the mailer to be hingeably opened along fold line 202 to expose the inner face of the mailer. See FIG. 15. The mailer conveniently opens to reveal the message area 204 and removable ID card 210, which can be easily removed and retained by the addressee or other appropriate receiver.

While the above discussion with respect to FIGS. 4 and 8, has described mailer blanks 20 and 140 formed by cutting webs made by laminating paper and transparent layers, which are subsequently cut into suitable lengths, it is understood that similar results, within the scope of the present invention, can be obtained by laminating individual sheets, already cut to the length of mailer blanks 20 and 140, of paper and transparent layers. Similarly, the mailer blanks with respect to FIGS. 11–15 have been described as pre-cut forms, but could alternatively be formed by laminating a plastic and paper web, and then cutting to length.

Another embodiment of the subject invention provides a mailer having an address viewing window and a return receipt postcard integral therewith. This embodiment is preferably used in connection with an automated folder/sealer for high volume mailings. Both the mailer and return receipt post card portions can have variable information, e.g., address information, correspondence text, postage indicia, or the like, printed on a single face thereof by a single pass through a simplex, non-impact printer. The mailer and return receipt post card portions can be manipulated such that the variable information can be viewed on their respective reverse faces. Variations of this embodiment, and the steps involved in its use, are illustrated in FIGS. 16–21. Generally, this embodiment of the subject invention comprises a two-ply form comprising front and back plies wherein these plies are adhered together in certain areas to form a single, laminated form of standard size, divided by fold lines or perforations into three distinct sections. Preferably, first and second sections form the mailer portion and third section forms the return postcard portion. The material for the plies can be any material, typically a paper material, which can be printed on by a standard simplex, non-impact printer. Such materials are commercially available and are described herein.

The front ply is a sheet of standard size, e.g., 8½×11, 8½×14 (legal size), A4, or the like, divided by fold lines or perforations into first, second, and third sections of particular size. The third section must be of sufficient dimension to form a postcard of standard size and to include an additional area which receives printed information on a first side or face from a simplex, non-impact printer. This additional area can then be folded back onto itself such that address information is in proper position on the reverse side or face of the postcard portion. Typically, this third section is approximately 1½times the standard height of a postcard. The first and second sections form the balance of the sheet and are of substantially equal size to each other such that they can be folded over along a fold line provided along the mid-line between the first and second sections to be mated with one another and form the mailer portion.

The back ply is a sheet which is equal in width to the first ply, but is truncated in length compared to the top ply so the bottom edge of the back ply meets the bottom edge of the third section of the top ply when the top ply is folded over, thereby forming a two-ply post card. The thickness of the plies are such that the post card formed thereby meets USPS requirements.

Figure 16:
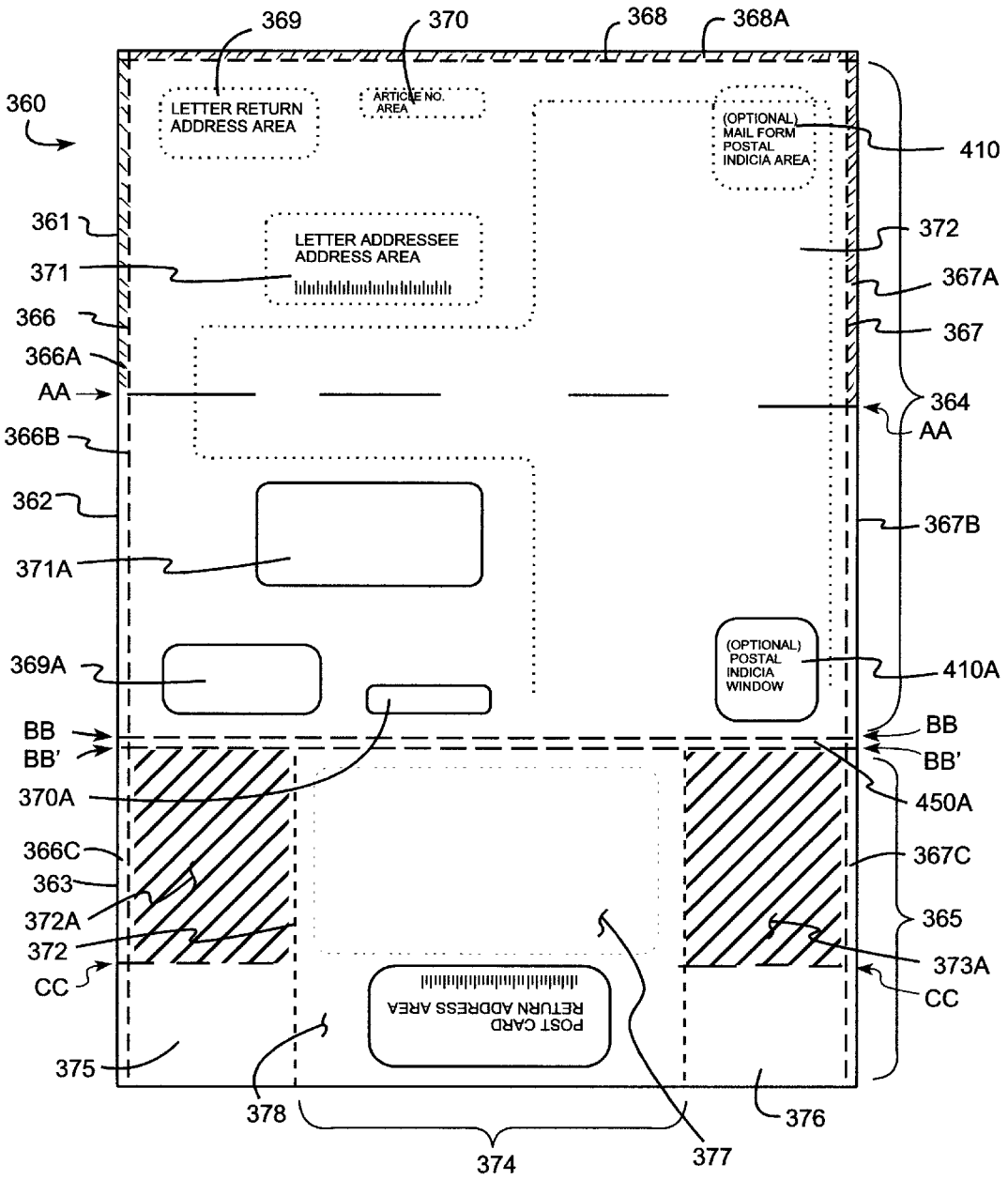
FIG. 16 shows a front face of the top ply of the form according to one embodiment of the subject invention.

FIG. 16 shows a front face of the top ply 360 of the form, having fold line AA to divide first section 361 from second section 362. Second section 362 is defined by fold line AA and perforation BB', and third section 363 is formed between perforation BB' and a bottom edge of the form. First and second sections 361 and 362 of top ply 360 form an inner face of mailer portion 364, and third section 363 forms post card portion 365. Top ply 360 also includes perforations 366 and 367 along the entire length of its side edges, and perforation 368 along its top edge.

First section 361 provides areas for printing variable information, including letter return address area 369, article number area 370, letter addressee area 371 (including bar coded address information) and letter text area 372. Optionally, area 410 can also be provided for printing of postage indicia, e.g., PC postage. The placement of these areas for printing variable information can be modified from the positions shown in FIG. 16 so long as they are within USPS regulations for positioning of mailing information.

Second section 362 provides windows 369A, 370A, and 371A for showing, respectively, letter return address area 369, article number area 370, and letter addressee area 371 through the top ply 360 so the information can be viewed. An optional window 410A can also be provided for viewing of postage indicia area 410. These window areas 369A, 370A, and 371A, and optional window area 410A are formed as cutout areas in the top ply 360. Window areas 369A, 370A, 371A, and 410A can be open cutouts or can be covered with a substantially transparent sheet (see FIG. 18 and accompanying text) to provide protection for the inner face of the mailer. It would also be understood that window areas 369A, 370A, 371A and optional window area 410A would be positioned in accordance with the respective positions of variable information areas 369, 370, 371, and optional variable information area 410 in first section 361 so these variable information areas show through the windows. Accordingly, any variation in positions of the variable information areas 369, 370, 371, or 410 would be reflected in complementary positional changes for the respective cutout window areas in first section 361.

First and second sections 361 and 362 include perforations 366 and 367 along, and offset approximately ¼to approximately ½inch from their side edges, to form tear-away strips 366A, 366B, 367A, and 367B. At least one of tear-away strips 366A and 366B, and at least one of tear-away strips 367A and 367B have a dry adhesive, preferably encapsulated glue as described herein or in the patents or applications incorporated by reference, disposed thereon so that when opposing faces of first and second sections are folded along fold line AA, adhesive disposed thereon contacts the opposing face along the interface of tear-away strips 366A and 366B and along the interface of tear-away strip 367A and 367B to hold the first and sections together along their side edges. Dry, encapsulated adhesive can also be disposed on at least one of either tear-away strip 368A, formed by perforation 368 along the top edge of first section 361, or in a mating configuration on the bottom edge of second section 362, between perforations BB and BB', which forms tear-away strip 450A. Tear-away strip 450A opposes tear-away strip 368A when first section 361 and second section 362 are folded over and mated to form the mailer portion 364 in the folded configuration of the mailer portion of the form. It would be understood that a preferred application of adhesive would be provided by an automated folder/sealer machine capable of disposing patterned adhesive at the time of folding and sealing the form. These folder/sealers are commercially available and are well known in the art. Such folder/sealers are generally capable of at least one of the following three variations: activating encapsulated adhesive in particular areas, moistening patterned moisture-activated adhesive, and patternly disposing adhesive. The form according to the subject inventions is adaptable to each of these various folder/sealers.

Third section 363 is adjoined at its top edge to bottom edge of section 362 to provide a section integral therewith, but is divided from second section 362 by perforation BB'. Perforation BB' provides a fold line such that the form can be folded therealong and be mated to the back face of back ply 390 when the mailer portion is in its folded configuration. An additional perforation BB can be provided on section 362, parallel to perforation BB', and separated therefrom approximately the same width as tear-away strip 368A to form tear-away strip 450A. Return receipt postcard 377 can be later separated from the mailer portion 364 along perforation BB' when the return receipt postcard is removed to be returned to the sender. Third section 363 also include perforations 366 and 367 continuing from first and second section 361 and 362 along the entire length of top ply 360 of the form.

Advantageously, however, third section 363 can also include perforations 372 and 373 spaced from the outer side edges of section 363 such that an area 374 the width of a standard post card in accordance with USPS requirements, is centrally formed in third section 363. Area 374 formed between perforations 372 and 1373 is divided approximately one-third of its height by fold line CC to provide a first face 377 of a post card and a second area 378 which can be folded along fold line CC to form a portion of a second, reverse face of the post card. First face 377 provides an area (shown within dots) which can receive variable information printed by the single pass through a simplex, non-impact printer, to identify the addressee or contents of the mailer. Second area 378 formed opposite fold line CC from area 377 can receive return information for the return receipt post card portion. Second area 378 is preferably printed in an inverted configuration relative to the information printed of first face 377 so that when second area 378 is folded along fold line CC, it mates with the corresponding preprinted area on the opposite face of top ply 360. For sending the mailer with a two-ply return receipt post card attached thereto, tab 372A defined within the left-shown outer edge of third section 363 and perforation 372 and fold line CC and perforation BB', and tab 373A defined within the right-shown outer edge of third section 363, perforation 373, perforation BB', and fold line CC, can receive encapsulated adhesive on top ply 360. These adhesive-receiving areas on tabs 372A and 373A allow the tabs 372A and 373A to be mated and adhered to a respective corresponding section of top section 391 on back ply 390 (see FIGS. 20 and 21).

Figure 17:
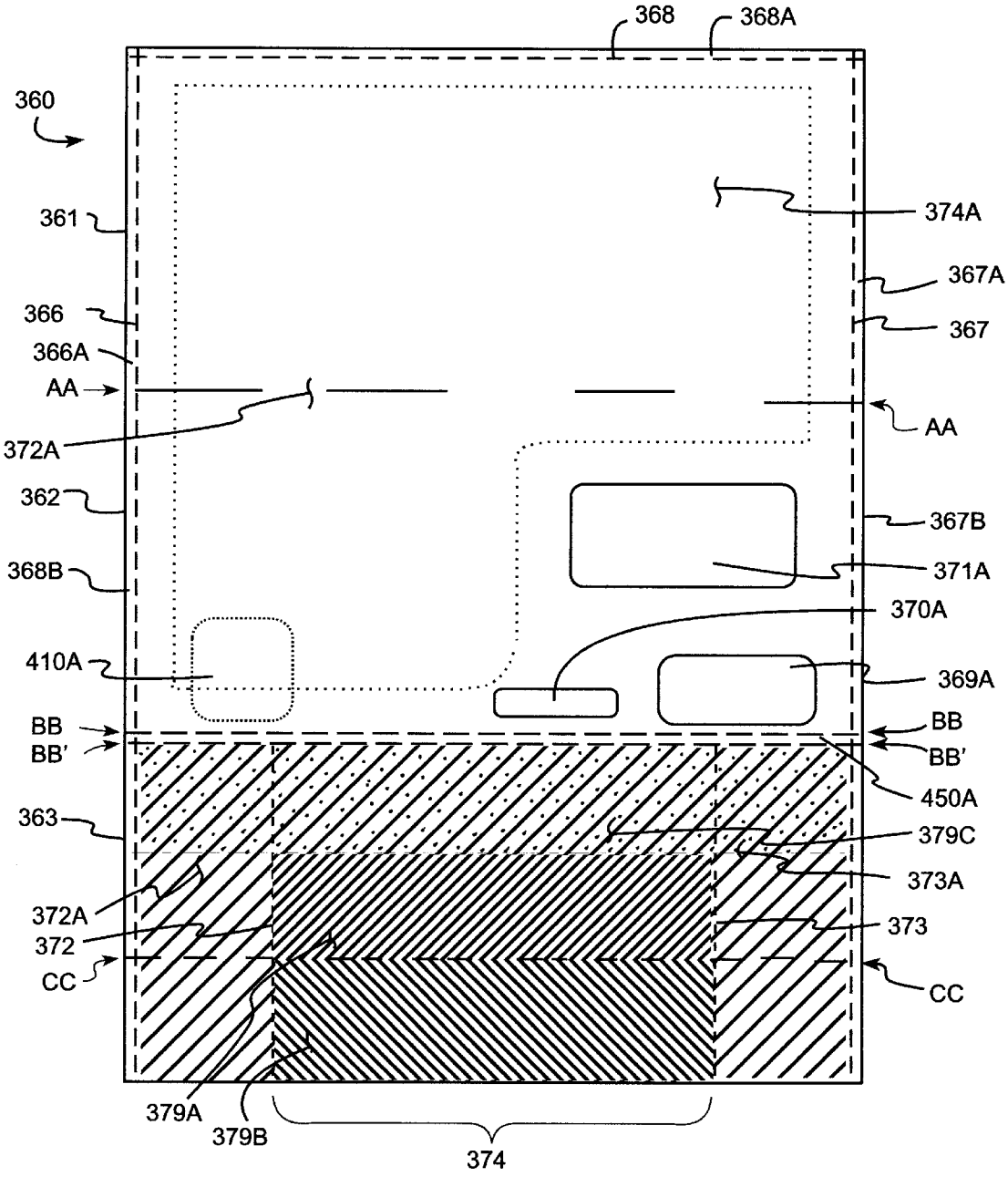
FIG. 17 shows the back face of the top ply of the form according to one embodiment of the subject invention.

FIG. 17 shows the back face of top ply 360, illustrating corresponding back faces of sections 361, 362, and 363 formed by fold line AA and perforation BB'. Also illustrated are corresponding fold line CC formed in third section 363, perforations 372 and 373 forming the area 374 of standard post card width, and edge perforations 366, 367, 368, and BB forming tear-away areas 366A, 367A, 368A, and 450A, respectively. Cutout window areas 369A, 370A, 371A, and optional window area 410A are shown shifted to the opposite side of top ply 360 in order to illustrate the face as it appears when front face of top ply 360 is viewed by turning it over. Area 374A (within dotted area on both sections 361 and 362) is a blank area which optionally can receive preprinted information to provide an additional page of text. This area 374A can be preprinted if top ply 360 is mated to the back ply only along perimeter edges, i.e., along tear-away areas 366A/366B, 367A/367B, and 368A/450A, to allow the plies to be separated and viewing of their inner faces. If the form is manufactured as a laminated form wherein top ply and back ply are adhered together, this area 374A, as well as the remaining surface of sections 361 and 362 can have permanent adhesive disposed substantially over their entire surface, or receive permanent adhesive disposed substantially over a corresponding opposing surface of the back ply or a third ply disposed between the top and back plies. Also shown are areas 379A and 379B (shaded) which extend from edge to edge, and equidistant from fold line CC. These areas 379A and 379B can receive encapsulated adhesive for folding over the bottom portion of section 363 (below fold line CC) to mate with a corresponding area of third section 363 above fold line CC. It would be understood that only one of the areas 379A or 379B require adhesive. This leaves area 379C, defined above area 379B and within perforations BB', 372 and 373, which can be disposed with permanent adhesive either on its own, or an opposing, mated surface.

As described in the other embodiments of the subject invention, it is understood that adhesive is disposed so as to leave an adhesive-free area of approximately 1/16inches along any edge of the form to allow for bleeding or oozing of the adhesive when plies are adhered together.

Figure 18:
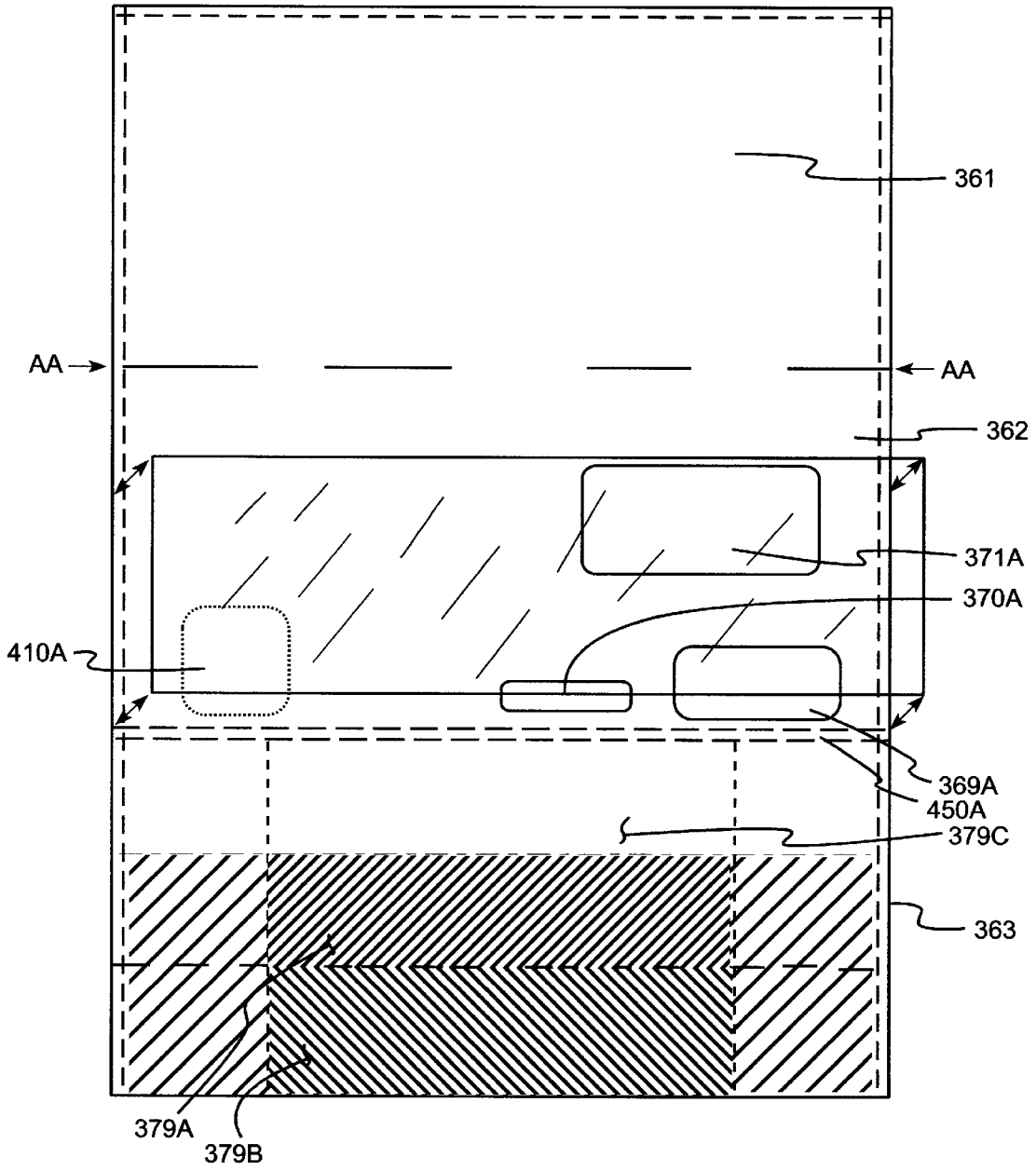
FIG. 18 illustrates a variation of the embodiment of FIG. 16 wherein a transparent sheet is provided over the cutout window areas.

FIG. 18 illustrates a variation of the embodiment of the subject invention wherein a back face of top ply 360, as illustrated in FIG. 17, includes a transparent covering 380 over cutout window areas 369A, 370A, and 371A and optional cutout window 410A provided in section 362. FIG. 18 illustrates a preferred embodiment wherein a single sheet of transparent material is disposed between the top and back plies, extending from one side edge to the other, and having a height which is capable of covering all window areas with a single sheet. This single sheet of transparent material advantageously provides a form which is easier to manufacture and less likely to cause jamming of a simplex, non-impact printer. The transparent sheet for covering the cutout window areas can be adhered to an inner face of either ply of the form, preferably the top ply, to seal the cutout window areas from the inner face of the plies, or can be adhered to both, if the form is configured as a single, laminated form.

Figure 19:
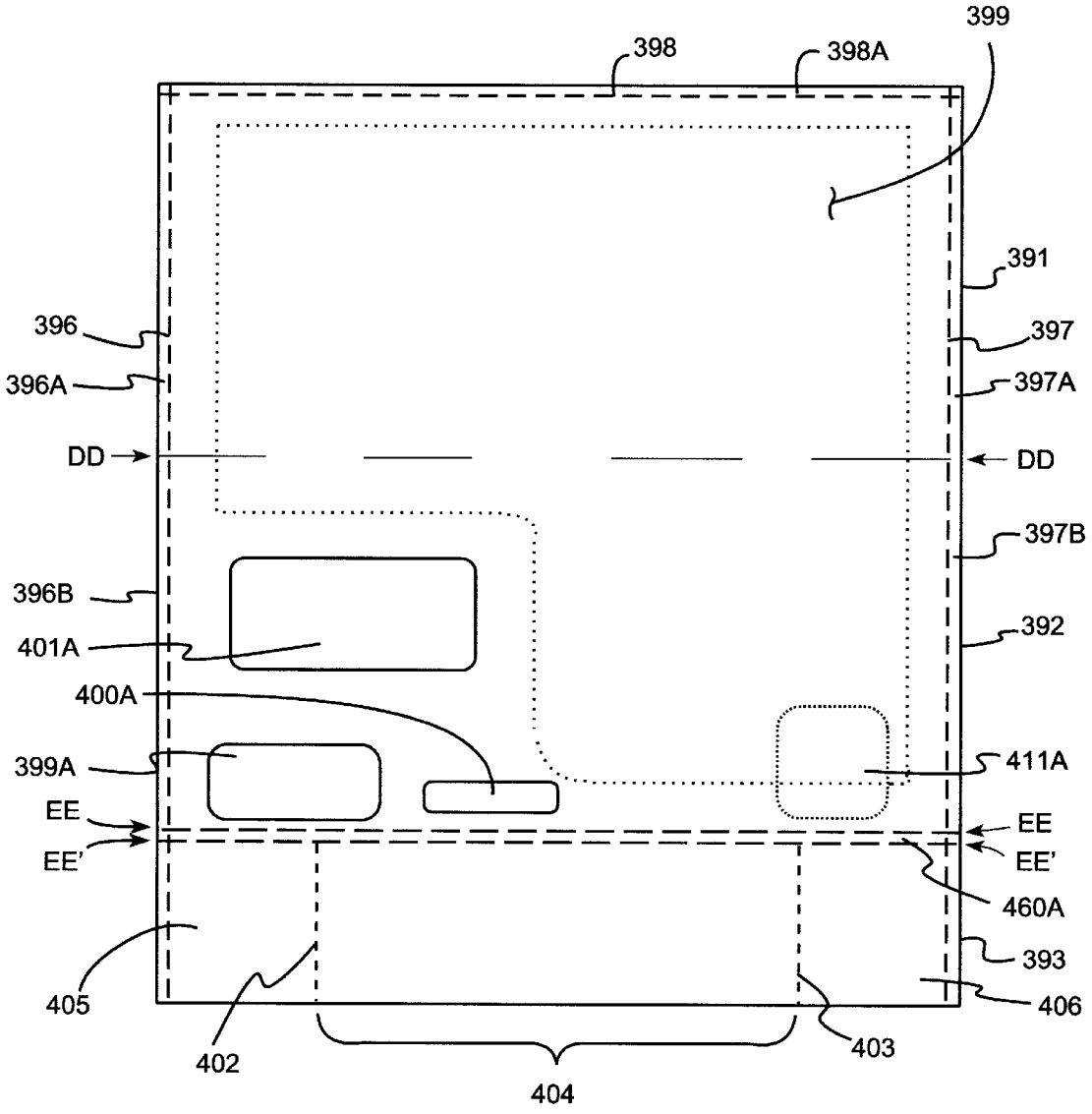
FIG. 19 shows an inner face of the back ply of the form according to one embodiment of the subject invention as shown in FIGS. 16–18.
Figure 20:
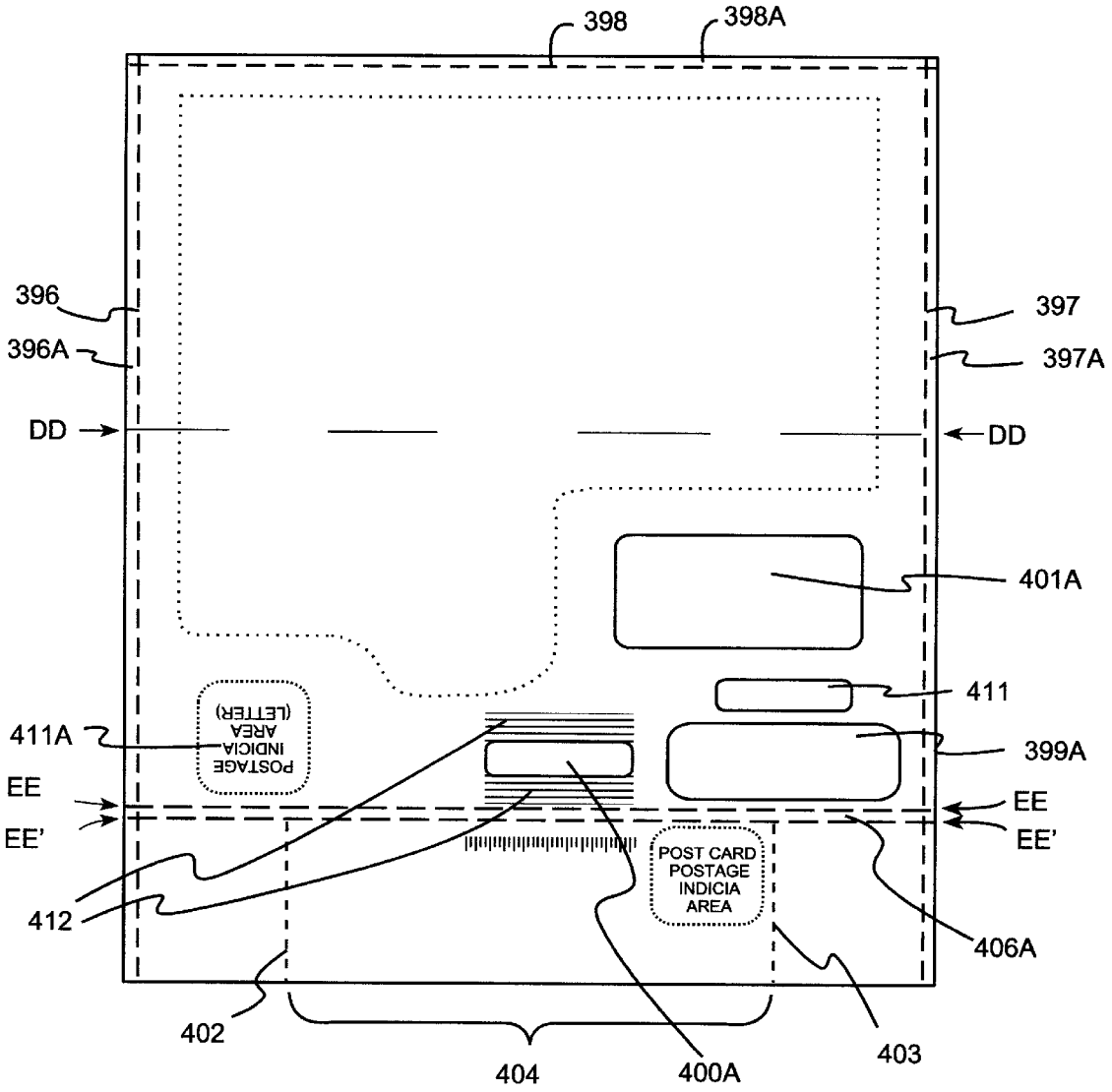
FIG. 20 shows the back, or outer face of the back ply of the form according to one embodiment of the subject invention as shown in FIGS. 16–18.

Inner and outer faces of back ply 390 are shown in FIGS. 19 and 20, respectively. As shown in FIG. 19, back ply 390 includes fold line DD to divide first section 391 and second section 392. Second section 392, which is of substantially identical size to first section 391 is defined by fold line DD and perforation EE'. These sections 391 and 392 positionally correspond to respective sections 361 and 362 of top ply 360. The first and second sections 391 and 392, shown, form an inner face of mailer portion 394, which corresponds to mailer portion 364 of top ply 360. Third section 393 is formed between perforation EE' and the bottom edge of the back ply. This third section 393 forms a top portion of the back face of post card 365. Top ply 390 also includes perforations 396 and 397 along the entire length of its side edges, perforation 398 along its top edge, and perforation EE, positionally corresponding to perforations 366, 367, 368, and BB of top ply 360, respectively.

Second section 392 provides windows 399A, 400A, 401A, and optional 411A positionally corresponding to window areas 369A, 370A, 371A, and 411A of top ply 360, for showing, respectively, letter return address area 369, article number area 370, and letter addressee area 371, and postage indicia area 410 printed on the inner face of top ply 360 so the information can be viewed. These window areas 399A, 400A, 401A, and optional window area 411A are formed as cutout areas in the bottom ply 390. Window areas 399A, 400A, 401A, and 411A can be open cutouts or can be covered with a substantially transparent sheet (see FIG. 18 and accompanying text) to provide protection for the inner face of the mailer.

First and second sections 391 and 392 provide an area 399 for preprinting information (shown within dots), preferably used for preprinted letter text area in a form adhered only along its perimeter edges to provide a form having separable laminations. The placement of these areas for printing text can readily be understood to be modifiable according to the positioning of the window areas in section 392. In a laminated variation of this embodiment, wherein top ply 360 and back ply 390 are not separable from one another such that the inner faces thereof cannot be viewed, area 399 can be substantially coated with a permanent adhesive or can be available for being mated to adhesive disposed on the inner face of top ply 360.

First and second sections 391 and 392 include perforations 396 and 397 along. and offset approximately ¼, to approximately ½inch from their side edges, to form tear-away strips 396A, 396B, 397A, and 397B. An additional tear-away strip 460A is defined by perforations EE and EE'. Preferably, tear-away strips 396A/396B, 397A/397B, and 398A/460A have an adhesive, as described herein or in the patents or applications incorporated by reference. disposed thereon so that when opposing faces of first and second sections of top ply 360 are laminated with back ply 390, adhesive disposed thereon contacts the opposing face along the interface of tear-away strips 396A/396B, 397A/397B, and 398A/460A to hold the top and back plies together along their side edges. It would be understood that this adhesive can be alternatively disposed on corresponding sections of the inner face of top ply 360, or can be disposed between the plies.

Third section 393 is adjoined at its top edge to bottom edge of section 392 at perforation EE' provide a third section integral with second and first sections. Perforation EE provides a fold line such that the form can be folded therealong and can be later separated from the mailer portion 394 when the return receipt postcard is removed to be returned to the sender. Third section 393 also includes perforations 396 and 397 continuing from first and second section 391 ad 392 along the entire length of back ply 390 of the form.

The third section 393 of back ply 390 also includes perforations 402 and 403 spaced from the outer side edges of section 393 such that an area 404 is centrally formed having a width of a standard post card in accordance with USPS requirements. Third section 393 extends from perforation EE to form an area approximately one-half to about two-thirds of the height of a post card of standard size, positionally corresponding to area 379C on top ply 360.

FIG. 20 shows the back, or outer, face of back ply 390, illustrating corresponding back faces of sections 391, 392, and 393 formed by fold line DD and perforation EE'. Also illustrated are corresponding perforations 402 and 403 forming the area 404 of standard post card width, and edge perforations 396, 397, 398, and EE forming tear-away areas 396A, 397A, 398A, and 460A, respectively. Area 404, defined by perforations 402, 403, EE' and the bottom edge of back ply 390 forms the top portion of the back face of the return receipt post card and can be preprinted with address or other identification information, or postage indicia. An advantageous feature of this embodiment is the exact matching of bottom edge of section 363 of top ply 360 to bottom edge of section 393 of back ply 390 when section 363 is folded at fold line CC, thereby forming a contiguous flat surface of a two-ply post card having a thickness compliant with USPS requirements. Cutout window areas 399A, 400A, 401A, and optional cutout window area 411A are shown shifted to the opposite side of back ply 390 in order to illustrate the appearance of back ply 390 when it is viewed by turning over the face illustrated in FIG. 19. Area 402A (within dotted area) is a blank area which optionally can receive preprinted information. Area 411 provides an area for preprinting of mailing information for special services, e.g., "return receipt requested" or the like. In accordance with USPS specification, area 411 must be positioned ¼inch below the return address. Areas 412 abutting or surrounding window area 400A are provided for preprinting of color or other indicator specific for the type of special mailing services being employed with the mailer.

Manufacturing the mailer according to this embodiment of the subject invention would be readily understood by those of ordinary skill in the form manufacturing art, using techniques and technologies that are readily available and commonly and currently used. Top and back plies are perforated and folded as described, and cutout window areas, including optional PC Postage window area, are formed therein, for example, by die-cuts. Permanent or encapsulated adhesive is applied in the appropriate areas and the top and back plies are adhered together either at their top and side edges, or by adhering substantially the entire inner surface of back ply to front ply as described.

Figure 21:
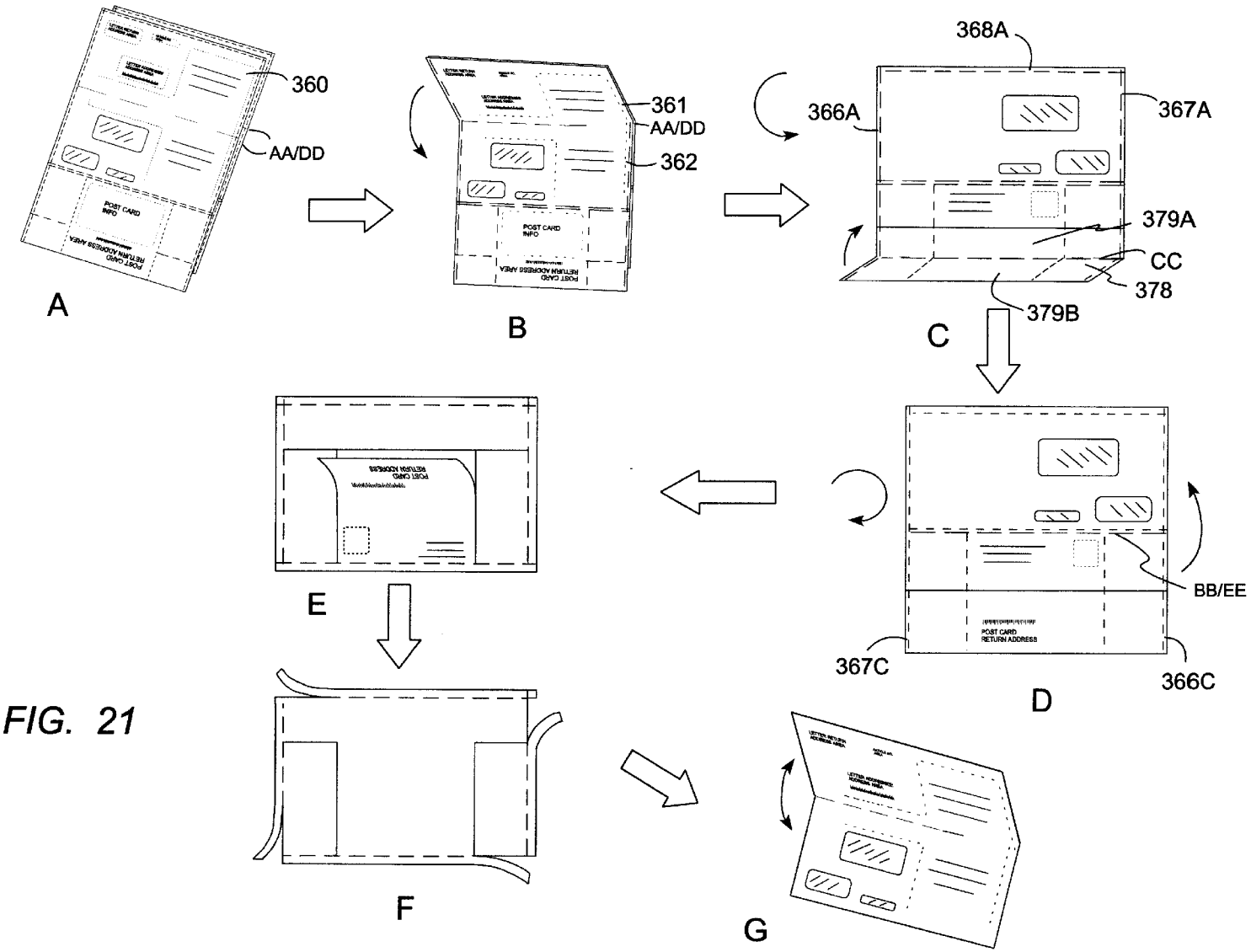
FIG. 21 shows the steps in folding and sealing the mailer according to the embodiment of the subject invention as shown in FIGS. 16–20.

For use of the mailer, automated folding and sealing machines, and simplex, non-impact printers standard in the industry can be employed to rapidly print, fold and seal the mailers for high-volume output. As illustrated in FIG. 21, after inner face of top ply 360 is printed with variable information, as needed (step A, shown in slightly exploded view to emphasize a two-ply laminated form), the mailer is V-folded by first folding along fold lines AA/DD (step B) to contact inner faces of sections 361 and 362 together, and adhering them together along the perimeter edges, namely, adhering tear-away strips 366A, 367A, and 368A to their corresponding areas, 366B, 367B, and 450A, respectively. Bottom section 378 of top ply 360 is then folded in an opposite direction along fold line CC (step C, viewed form the reverse face relative to steps A and B), termed herein a modified Z-fold, so that section 379B is made to mate with and adhere to section 379A on the back face of top ply 360 to form a two-ply, permanently adhered postcard. The two-ply post card is then folded along perforations BB/EE over the folded section 391, now mated to sections 362 and 392, and adhered along edges 366C and 367C and by tab areas 372A and 373A to form a sealed mailer having an attached return receipt post card (step D). Alternatively, the postcard portion can be formed prior to the mailer portion.

When the mailer is delivered, the return receipt post card can be detached from the mailer along perforations BB'/EE', 372/402, and 373/403 (step F) and mailed to the sender as a regular post card. The addressee of the mailer can then remove tear-away sections 166A/166B, 367A/367B and 368A/450A (step F) to defeat the adhesive disposed thereon and, as shown in step G, open the mailer for viewing of the information printed on the inner face of top ply 360. If top ply 360 and back ply 390 are adhered only along the tear-away strips, the mailer provides the addressee with optional text viewable on the inner faces of top ply 360 and back ply 390, as well.

While the invention has been described in its preferred form or embodiment with some degree of particularity, it is understood that this description has been given only by way of example and that numerous changes in the details of construction, fabrication and use, including the combination and arrangement of parts, may be made without departing from the spirit and scope of the invention.

What is claimed is:

1. A two-ply mailer form for use with an automated folder/sealer, and printable by a single pass through simplex, non-impact printer, said form comprising:

a top ply of standard paper size having a top and bottom edge, said top ply comprising a plurality of sections, including at least first and second sections which are foldable to form a mailer portion, and an integral third section having a portion which is foldable so that the third section of the front ply forms a front face of a standard post card and a portion of a back face of the standard post card; and a back ply having a top and bottom edge and superimposably adhered to said top ply, said back ply comprising first and second sections of identical width and height to said first and second sections of said top ply, and an integral third section having identical width to the third section of said top ply and having its height truncated in relation to said top ply such that the bottom edge of said back ply meets with the bottom edge of said third section of said top ply after said top ply is folded to form the standard postcard.

2. The mailer of claim 1, wherein said top ply has an outer face which can receive variable information printed by a single pass through the simplex, non-impact printer.

3. The mailer of claim 2, wherein the top ply has an outer face which can receive variable information selected from addressee information, return address information, postage indicia, correspondence text, and special mailing services identification.

4. The mailer of claim 1, wherein one of said first and second sections of front and back plies comprises at least one cutout area providing a window for viewing variable information printed on the outer face of the top ply.

5. The mailer of claim 4, wherein the mailer comprises a transparent sheet disposed between said top and back plies for covering said window areas.

6. The two-ply mailer of claim 1, wherein the top and back plies include perforations which form tear-away strips which can be removed to permit the opening of the mailer portion for viewing information printed thereon.

7. The mailer of claim 6, wherein the top and back plies are superimposably adhered only along the tear-away strips such that the top and back plies separate from one another for viewing inner faces thereof.

8. The mailer of claim 7, wherein the inner faces of the top and back plies are preprinted to provide second and third pages of available text area.

9. The mailer of claim 1, wherein the postcard is capable of receiving variable information positioned on front and back faces thereof by a single pass through the simplex, non-impact printer, and whereby the variable information positionable on the back face thereof is so positioned by folding a bottom portion of the post card portion onto itself and adhering the folded bottom portion to the back face of the top ply.

10. The mailer of claim 9, wherein the post card is two-ply having a thickness compliant with USPS requirements.

11. The mailer of claim 1, wherein the post card portion is removable from the mailer portion along a perforation dividing the post card and mailer portions.

12. The mailer of claim 1, wherein the post card portion includes vertical perforations separated by a distance to form a postcard of standard width, wherein the vertical perforations further provide a means for separating the post card from the remaining portion of the third section.

* * * * *